US006122589A

United States Patent [19]

Yamaguchi et al.

[11] Patent Number: 6,122,589

[45] Date of Patent: Sep. 19, 2000

[54] FUEL INJECTION CONTROL SYSTEM FOR ENGINE

[75] Inventors: Masashi Yamaguchi; Shigeki Hashimoto, both of Iwata, Japan

[73] Assignee: Yamah Hatsudoki Kabushiki Kaisha, Shizuoka-ken, Japan

[21] Appl. No.: 09/289,532

[22] Filed: Apr. 9, 1999

[30] Foreign Application Priority Data

Apr. 9, 1998 [JP] Japan ..... 10-097200
Apr. 10, 1998 [JP] Japan ..... 10-098748

[51] Int. Cl.[7] ..... F02D 41/04

[52] U.S. Cl. ..... 701/106; 123/480; 123/674

[58] Field of Search ..... 123/674, 480, 123/479, 675, 679, 694; 701/103, 106, 109, 110

[56] References Cited

U.S. PATENT DOCUMENTS

| | | | |
|---|---|---|---|
| 4,987,888 | 1/1991 | Funabashi et al. | 701/110 |
| 4,991,102 | 2/1991 | Sakamoto et al. | 701/109 |
| 5,033,437 | 7/1991 | Hori et al. | 123/674 |
| 5,657,737 | 8/1997 | Ishida et al. | 123/674 |
| 5,752,492 | 5/1998 | Kato et al. | 123/674 |
| 5,954,783 | 9/1999 | Yamaguchi et al. | 701/106 |

FOREIGN PATENT DOCUMENTS

| | | |
|---|---|---|
| 62-210235 | 9/1987 | Japan . |
| 63-297752 | 12/1988 | Japan . |
| 1-106955 | 4/1989 | Japan . |

*Primary Examiner*—John Kwon
*Assistant Examiner*—Hieu T. Vo
*Attorney, Agent, or Firm*—Knobbe, Martens, Olson & Bear, LLP

[57] ABSTRACT

A fuel injection control system of an engine includes: (a) an intake air quantity estimation unit for estimating the quantity of intake air; (b) an intake fuel quantity estimation unit for estimating the quantity of intake fuel; (c) an estimated air-fuel ratio calculation unit for calculating an estimated air-fuel ratio; (d) a target air-fuel ratio setting unit for setting a target air-fuel ratio; (e) a feedback control unit for providing a fuel injection signal to the engine, which fuel injection signal is outputted also to the intake fuel quantity estimation unit as one of the predetermined signals; and (f) an actual air-fuel ratio deviation estimation unit for estimating a deviation of an actual air-fuel ratio or a factor correlated thereto from a predetermined level, which unit is programmed to output a deviation signal based on predetermined signals. In the above, at least one unit selected from the intake air quantity estimation unit, the intake fuel estimation unit, and the target air-fuel ratio setting unit is provided with a learning function which is programmed to modify output from the at least one unit based on the deviation signal used as teacher data to minimize the deviation. The system requires a reduced number of sensors.

18 Claims, 39 Drawing Sheets

FUEL INJECTION CONTROL SYSTEM FOR ENGINE

BACKGROUND OF THE INVENTION

1. Field of the Invention

This invention relates to an engine control system, and particularly to that for controlling injection of fuel.

2. Description of Related Art

Heretofore, in an engine of a type wherein a fuel is injected into an intake pipe, by installing an air-fuel sensor sensing the air-fuel ratio (A/F) of an exhaust gas upon combustion, the fuel injection quantity is subjected to feedback control in order to control the air-fuel ratio at a target air-fuel ratio. Accordingly, engine performance, exhaust gas characteristics, and fuel efficiency are improved. In the above fuel injection control system, when the A/F has changed from a fuel-lean state to a fuel-rich state, the fuel injection quantity is reduced, thereby gradually changing the A/F to a fuel-lean state. When the A/F has changed from a fuel-rich state to a fuel-lean state, the fuel injection quantity is increased. Accordingly, the A/F can be controlled at the target A/F.

In the above air-fuel ratio control system, it is possible to match the current air-fuel ratio to the target air-fuel ratio if the intake air quantity is accurately calculated and accordingly the fuel injection quantity is controlled. However, in practice, because the fuel injection quantity and the intake air quantity fluctuate for various reasons, a discrepancy between the current air-fuel ratio and the target air-fuel ratio occurs. All of the fuel injected into the intake pipe does not go into a combustion chamber, and a part of the fuel is deposited on a wall of the intake pipe. The fuel deposited on the wall is vaporized at a rate changeable depending on the time constant for evaporation regulated by engine revolutions and the temperature of the wall of the intake pipe. Further, the fuel deposition ratio indicating the quantity of fuel deposited on the wall changes in accordance with the engine operation. The air intake quantity also fluctuates with time depending on the engine conditions themselves such as the timing of valving and environmental changes around the engine including changes in intake temperature or ambient pressure (a change in air density).

In order to resolve the above problem, many sensors and control maps are required in the conventional feedback control to reduce the above-mentioned discrepancy in the A/F. Further, response characteristics suffer due to complex control flows. Thus, the conventional feedback control cannot achieve accurate air-fuel ratio control. Further, there is a dead time from the time fuel is injected to the time the fuel enters into the combustion chamber, and thus, during a transition state of the engine where the throttle angle changes widely, response characteristics suffer. Accurate air-fuel control cannot be performed.

An objective of the present invention is to provide a simple engine control system using a minimum number of sensors and performing accurate air-fuel ratio control, thereby solving the above problems and satisfying market requirements.

SUMMARY OF THE INVENTION

One important aspect of the present invention attaining the above objective is to provide a fuel injection control system of an engine which is operable by a signal of fuel injection quantity on an intake side of the engine, and the performance of which is indicatable by a signal of the air-fuel ratio on an exhaust side of the engine, said control system comprising: (a) an intake air quantity estimation unit for estimating the quantity of intake air, which is programmed to output an estimated intake air quantity signal based on predetermined input signals of engine conditions; (b) an intake fuel quantity estimation unit for estimating the quantity of intake fuel, which is programmed to output an estimated intake fuel quantity signal based on predetermined input signals of engine conditions; (c) an estimated air-fuel ratio calculation unit for calculating an estimated air-fuel ratio, which is programmed to output an estimated air-fuel ratio signal when receiving the estimated intake air quantity signal and the estimated intake fuel quantity signal; (d) a target air-fuel ratio setting unit for setting a target air-fuel ratio, which is programmed to output a target air-fuel ratio signal based on predetermined input signals of engine conditions; and (e) a feedback control unit for providing a fuel injection signal to the engine, which is programmed to provide a fuel injection signal for controlling fuel injection when receiving and comparing the estimated air-fuel ratio signal and the target air-fuel ratio signal, said fuel injection signal being outputted also to the intake fuel quantity estimation unit as one of the predetermined input signals. In the above, at least one unit is selected from the intake air quantity estimation unit, the intake fuel estimation unit, and the target air-fuel ratio setting unit is provided with a learning function. The learning function is programmed to modify output from the at least one unit based on teacher data, wherein the teacher data used in the intake air quantity estimation unit and the intake fuel quantity estimation unit are a deviation of the actual air-fuel ratio from the estimated air-fuel ratio under given engine conditions, and the teacher data used in the target air-fuel ratio setting unit are a factor correlated to the actual air-fuel ratio under given engine conditions.

In the present invention, the estimated air-fuel ratio is determined by calculating the estimated intake air quantity and the estimated intake fuel quantity, and the estimated air-fuel ratio is compared with the actual air-fuel ratio in the exhaust. The control is conducted in such a way as to minimize the discrepancy between the estimated air-fuel ratio and the actual air-fuel ratio in the exhaust, by outputting learning signals. Accordingly, accurate control over the air-fuel ratio can be achieved by simple control using a minimum number of sensors.

As another important aspect, the present invention can be adapted equally to a method for fuel injection control of an engine in the same manner as above.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF THE PREFERRED EMBODIMENTS OF THE INVENTION

The engine control system of the present invention will be explained further with reference to embodiments. In the embodiments, the subject to be controlled is an engine installed in vehicles or vessels, the performance of which engine is controlled by the quantity of fuel injected into an intake pipe. The present invention can be adapted to any type of engine as long as its performance is controlled by fuel injection quantity.

Figure 1:
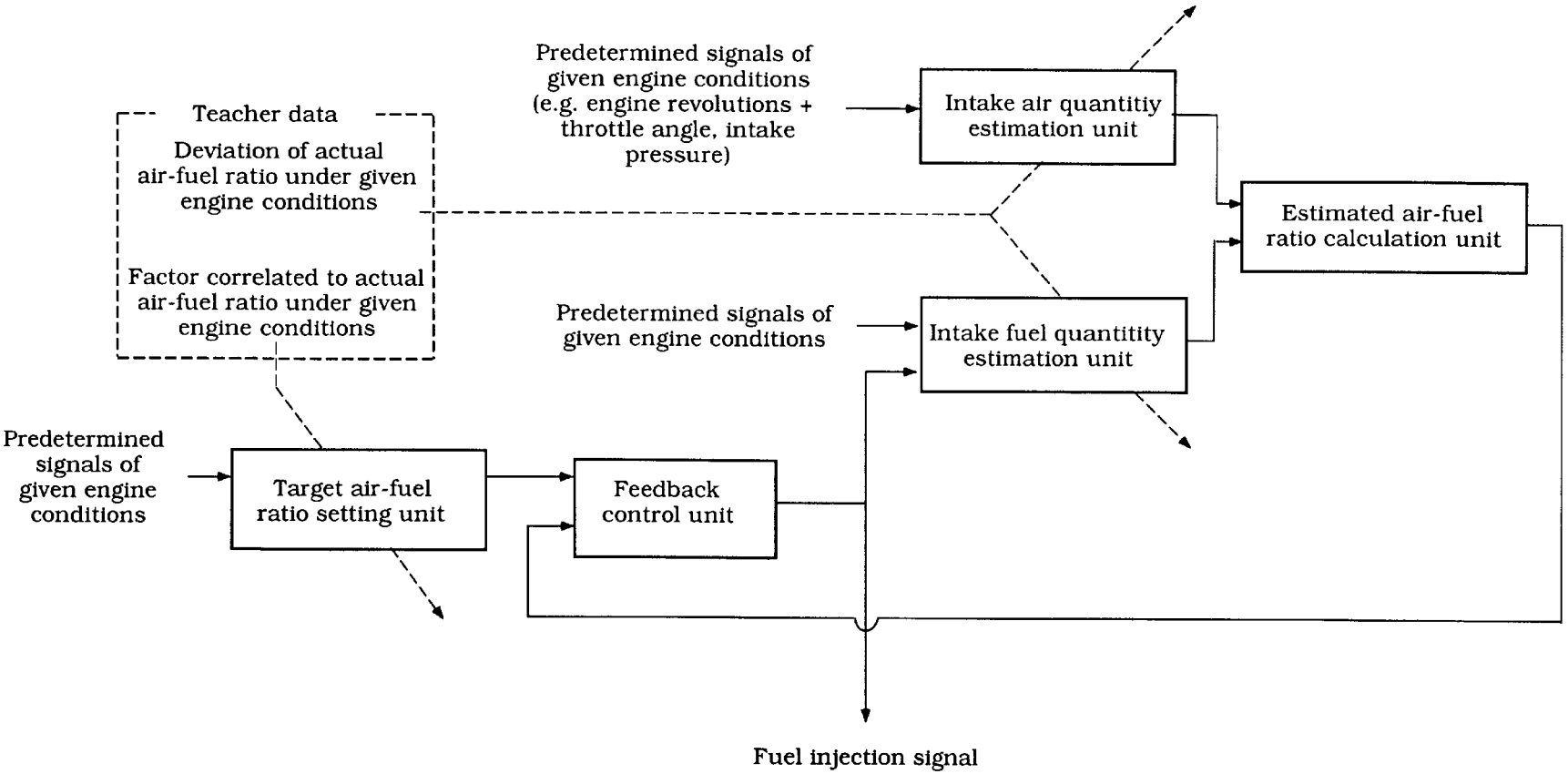
FIG. 1 is a schematic block diagram illustrating an example of the fuel injection control system of the present invention.

The fuel injection control system of the present invention is schematically illustrated in FIG. 1. That is, the fuel injection control system comprises: (a) an intake air quantity estimation unit for estimating the quantity of intake air, which is programmed to output an estimated intake air quantity signal based on predetermined input signals of engine conditions; (b) an intake fuel quantity estimation unit for estimating the quantity of intake fuel, which is programmed to output an estimated intake fuel quantity signal based on predetermined input signals of engine conditions; (c) an estimated air-fuel ratio calculation unit for calculating an estimated air-fuel ratio, which is programmed to output an estimated air-fuel ratio signal when receiving the estimated intake air quantity signal and the estimated intake fuel quantity signal; (d) a target air-fuel ratio setting unit for setting a target air-fuel ratio, which is programmed to output a target air-fuel ratio signal based on predetermined input signals of engine conditions; and (e) a feedback control unit for providing a fuel injection signal to the engine, which is programmed to provide a fuel injection signal for controlling fuel injection when receiving and comparing the estimated air-fuel ratio signal and the target air-fuel ratio signal, said fuel injection signal being outputted also to the intake fuel quantity estimation unit as one of the predetermined input signals. In the above, at least one unit is selected from the intake air quantity estimation unit, the intake fuel estimation unit, and the target air-fuel ratio setting unit is provided with a learning function. The learning function is programmed to modify output from the at least one unit based on teacher data, wherein the teacher data used in the intake air quantity estimation unit and the intake fuel quantity estimation unit are a deviation of the actual air-fuel ratio from the estimated air-fuel ratio under given engine conditions, and the teacher data used in the target air-fuel ratio setting unit are a factor correlated to the actual air-fuel ratio under given engine conditions.

In one preferred embodiment, the intake air quantity estimation unit and/or the intake fuel quantity estimation unit are/is provided with the learning functions, and an actual air-fuel ratio sensor is provided on the exhaust side of the engine and measures the actual air-fuel ratio to determine the teacher data. The learning functions can be used for determining the volumetric efficiency and/or for determining a final adjustment for the outputted estimated intake air quantity. Preferably, the intake air quantity estimation unit receives the teacher data when the engine conditions are included in a normal driving state. For example, a change in the volumetric efficiency is a more significant parameter in a normal driving state than in a transition driving state, and thus modifying the volumetric efficiency in a normal driving state is effective.

Further, preferably, the intake fuel quantity estimation unit receives the teacher data when the engine conditions are included in a transition driving state. The learning functions can be used for determining the evaporation time constant and/or for determining the fuel deposition ratio. Preferably, the intake fuel quantity estimation unit receives the teacher data when the engine conditions are included in a transition driving state. For example, a change in the evaporation time constant is a more significant parameter in a transition driving state (wherein the throttle angle is drastically changed) than in a normal driving state, and thus modifying the evaporation time constant in a transition driving state is effective.

In another preferred embodiment, the target air-fuel ratio setting unit is provided with the learning function, and the factor correlated to the actual air-fuel ratio is an engine revolution fluctuation. By using the engine revolution fluctuation, it is possible to eliminate the use of an air-fuel ratio sensor, thereby reducing the number of sensors necessary for engine control. In this embodiment, the intake air quantity estimation unit or the intake fuel quantity estimation unit need not be provided with the learning function. The target air-fuel ratio setting unit undergoes learning based on engine revolution fluctuations correlated to the actual air-fuel ratio under given engine conditions, in order to always properly output the target air-fuel ratio. Incidentally, this embodiment can be combined with the aforesaid embodiment.

Further, in the above system, the predetermined input signals for the intake air quantity estimation unit may include engine revolutions and throttle angle. The predetermined input signals for the intake air quantity estimation unit may also include engine revolutions and intake pressure. By using the intake pressure as a predetermined input signal, it is possible to an eliminate a throttle valve sensor, and improve the response characteristics and accuracy. Incidentally, instead of intake pressure, an air flow meter can be used.

The predetermined signals for the intake air quantity estimation unit may be selected from the group consisting of signals of engine revolutions, throttle angle, and intake pressure. Further, the predetermined signals for the intake fuel quantity estimation unit may be selected from the group consisting of signals of engine revolutions, throttle angle, intake pressure, engine temperature, and intake pipe wall temperature, and a signal of the estimated intake air quantity outputted from the intake air quantity estimation unit, in addition to the fuel injection signal outputted from the feedback control unit. Furthermore, the predetermined signals for the target air-fuel ratio setting unit may be selected from the group consisting of signals of engine temperature and engine revolutions, and a signal of the estimated intake air quantity outputted from the intake air quantity estimation unit.

In the above, the learning functions are preferably fuzzy neural networks because the input-output relationship can be defined relatively easily, but other devices such as CMAC (Cerebellar Model Arithmetic Computer) can be used.

Accordingly to the present invention including the above embodiments, accurate control over the air-fuel ratio can be achieved by simple control using a minimum number of sensors. The present invention will be explained in detail with reference to the figures.

Engine Control System

FIGS. 2–13 indicate a first embodiment of the fuel injection control system according to the present invention.

Figure 2:
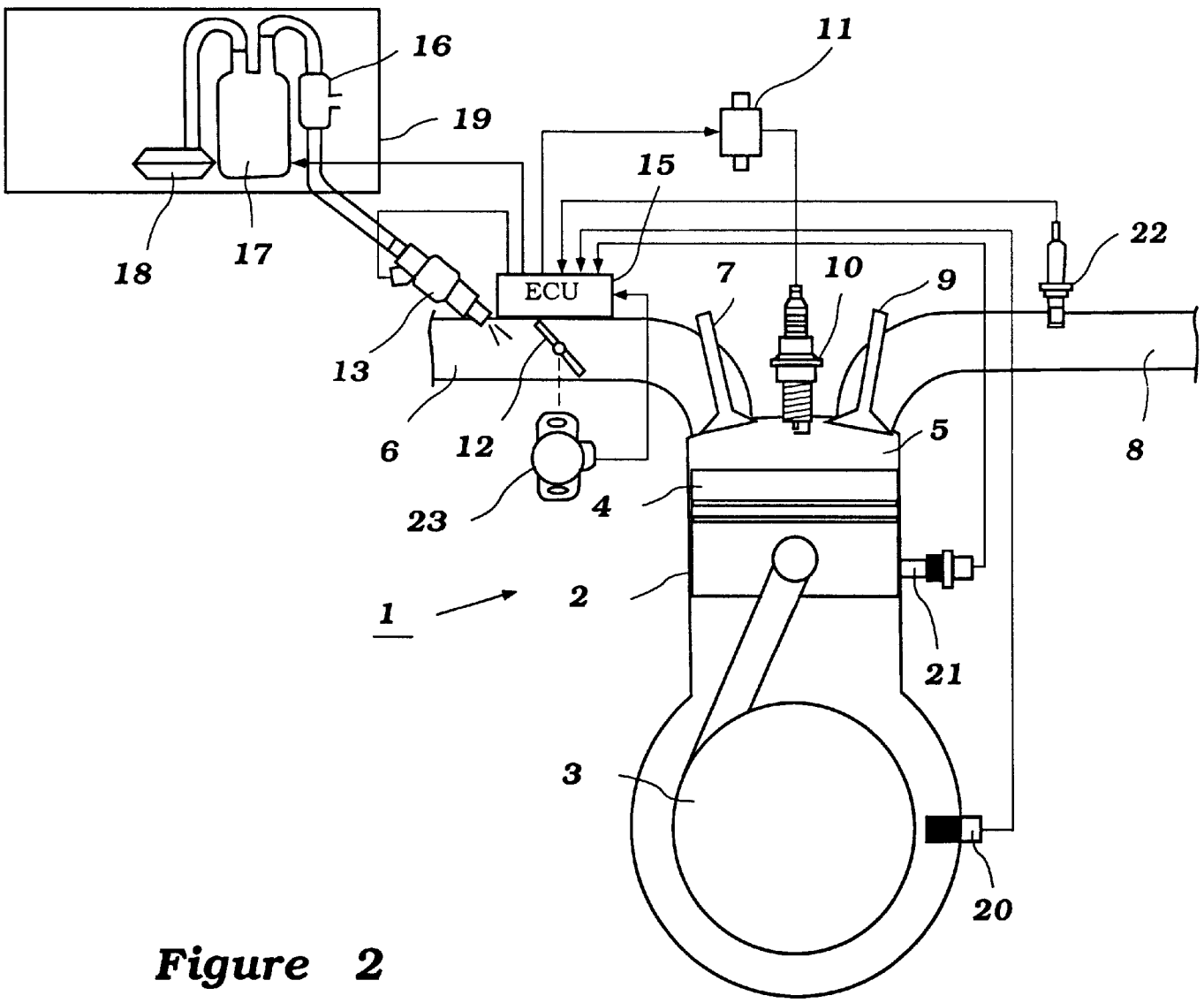
FIG. 2 is a schematic diagram illustrating a first embodiment of the injection control system installed in a four-cycle engine, according to the present invention.

FIG. 2 shows a schematic diagram of an engine control system installed in vehicles or vessels, wherein the relationship between a four-cycle engine 1 and a controller 15 for operating an engine control system is illustrated. This system is for controlling air-fuel ratio A/F of the engine 1 at a desired value.

The engine 1 is provided with a cylinder body 2, a crank shaft 3, a piston 4, a combustion chamber 5, an intake pipe 6, an intake valve 7, an exhaust pipe 8, an exhaust valve 9, an ignition plug 10, and an ignition coil 11. In the intake pipe, a throttle valve is disposed. An injector 13 is disposed upstream of the throttle valve 12. Further, a box including an ECU (controller) 15 is provided on the wall of the intake pipe 6. The injector 13 is connected to a fuel tank 19 via a pressure valve 16, a fuel pump 17 driven by an electric motor, and a filter 18.

Figure 3:
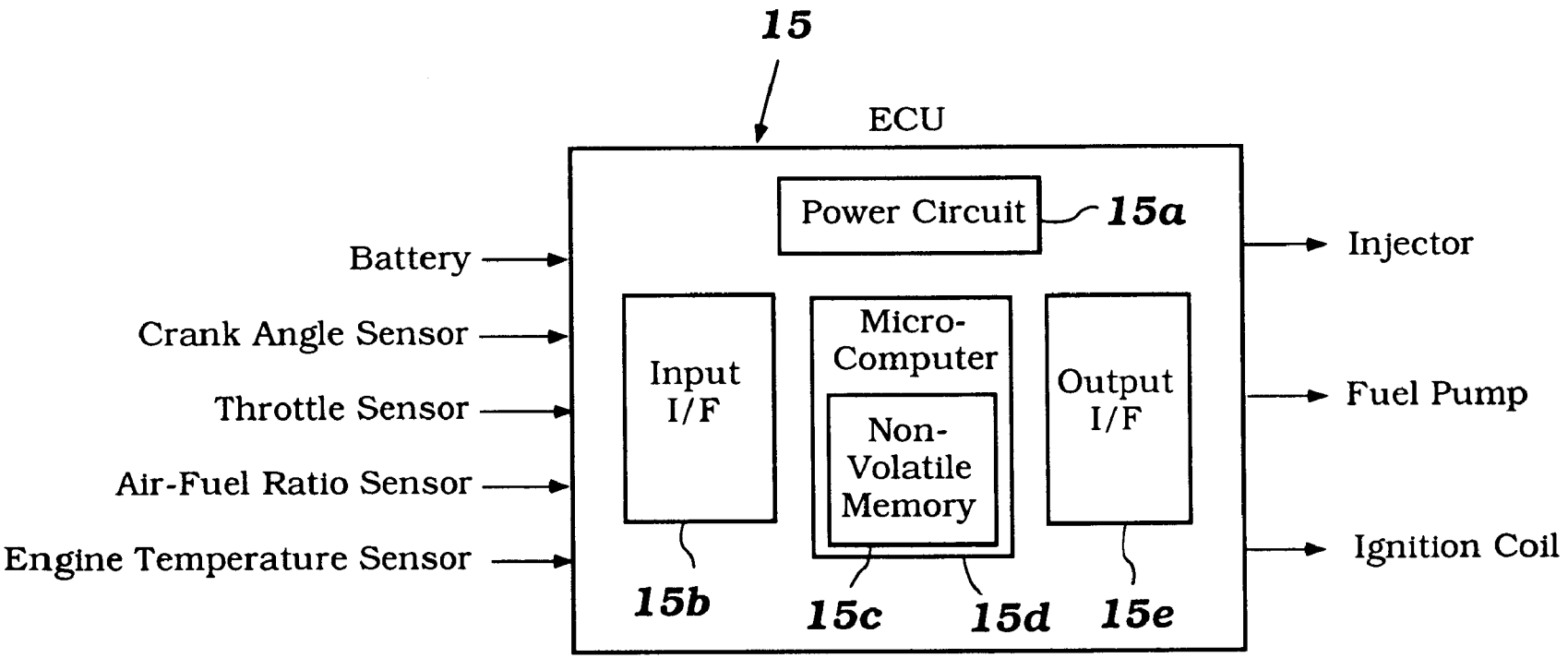
FIG. 3 is a schematic diagram of the controller 15 indicated in FIG. 2.

To the controller 15, detection signals from various sensors detecting driving conditions of the engine 1 are provided. That is, the various sensors include a crank angle sensor 20 (engine revolutions detector) for sensing the revolution angle of the crank shaft 3, an engine temperature detector 21 for detecting the temperature of the engine itself, an air-fuel ratio detector 22 for detecting the air-fuel ratio in the interior of the exhaust pipe 8, and a throttle angle detector 23 for detecting the angle of the throttle valve 12. The controller 15 processes the detection signals from each sensor, and provides them to the injector 13, the fuel pump 17, and the ignition coil 11. As shown in FIG. 3, the controller 15 comprises an electric circuit 15*a* connected to a battery, an input I/F 15*b*, a microcomputer 15*d* including an non-volatile memory 15*c*, and an output I/F 15*e*.

Control Unit

Figure 4:
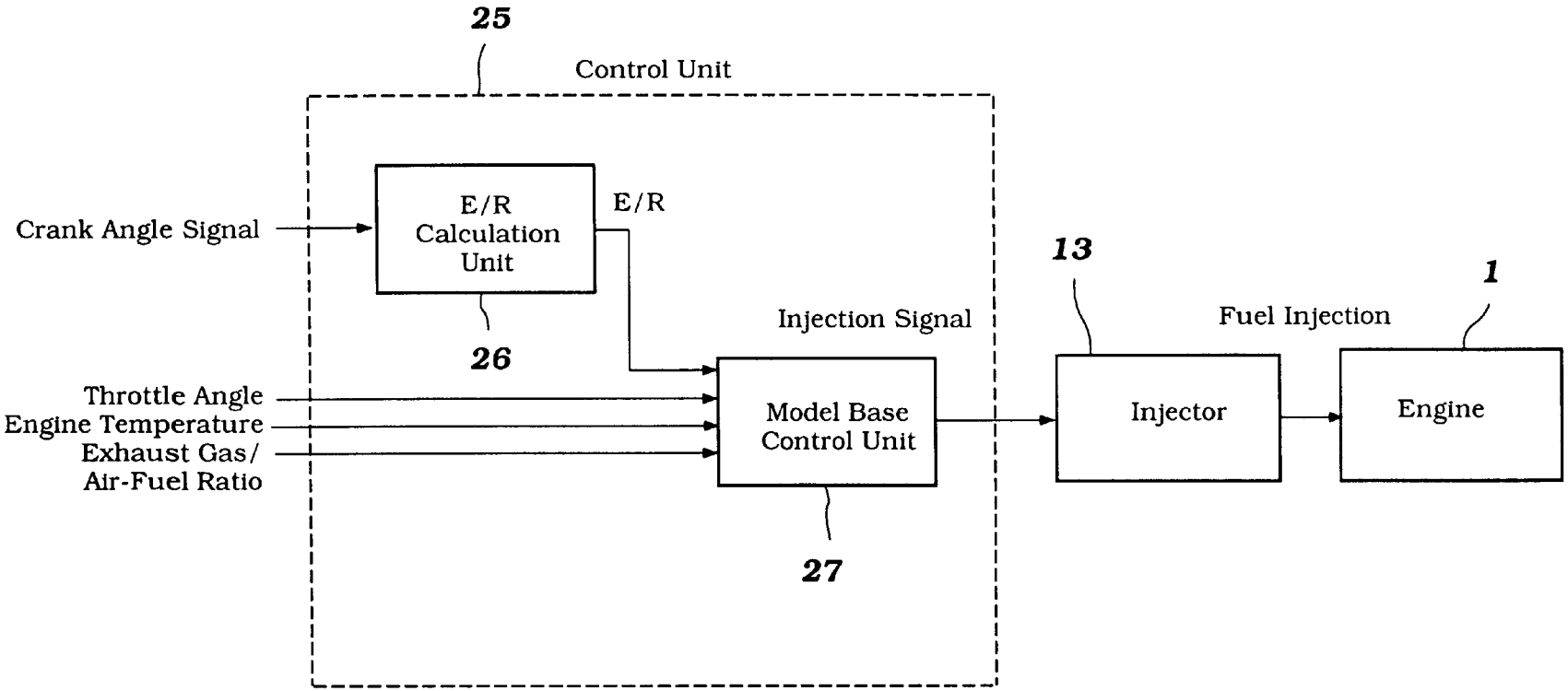
FIG. 4 is a schematic block diagram of a control unit regulating the injector, which control is processed in the microcomputer 15*d* of FIG. 3.

FIG. 4 is a schematic block diagram of a control unit regulating the injector, which control is processed in the microcomputer 15*d* of FIG. 3. A control unit 25 comprises an engine revolutions calculation unit 26 for calculating engine revolutions based on the crank angle signal, and a model-based control unit 27 which is featured by the present invention. The model-based control unit 27 processes signals of engine revolutions, the throttle angle, the engine (body) temperature, and the air-fuel ratio in a manner described later, and outputs an injection signal to the injector 13.

Model-Based Control Unit

Figure 5:
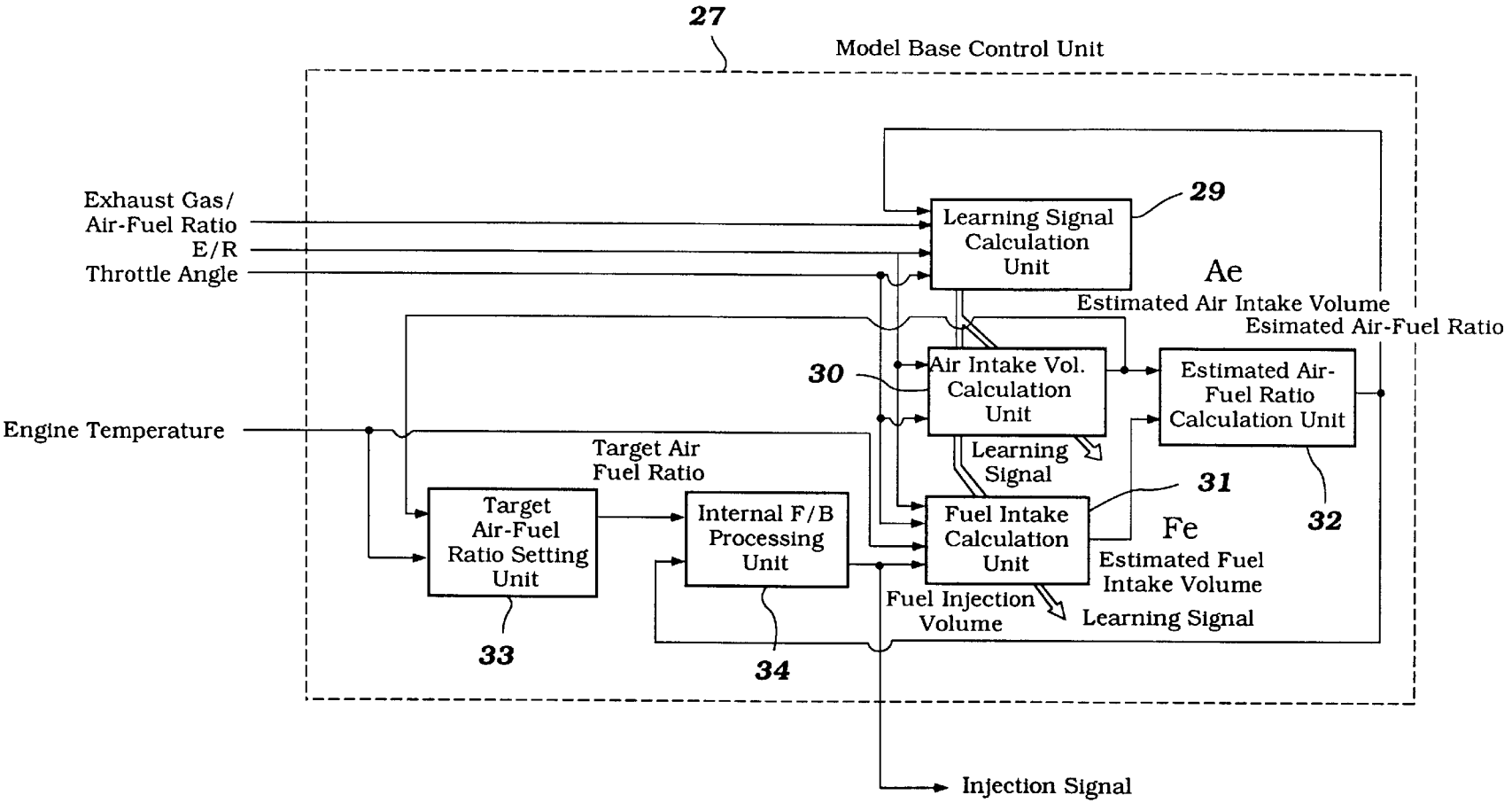
FIG. 5 is a schematic block diagram showing the structure of the model-based control unit 27 of FIG. 4.

FIG. 5 is a schematic block diagram showing the structure of the model-based control unit 27 of FIG. 4. The model-based control unit 27 comprises an intake air quantity calculation unit 30 and an intake fuel quantity calculation unit 31, which function as a learning model for calculating the intake air quantity and the intake fuel quantity based on learning signals (teacher signals) outputted from a learning signal calculation unit 29. The control unit 27 further comprises an estimated air-fuel ratio calculation unit 32 for calculating the estimated air-fuel ratio based on the intake air quantity and the intake fuel quantity, a target air-fuel ratio setting unit 33 for setting the target air-fuel ratio based on the calculated estimated air-fuel ratio and the engine temperature, and an internal F/B (feedback) processing unit 34 for controlling the fuel injection quantity based on the set target air-fuel ratio and the estimated air-fuel ratio. Each of the calculation unit, setting unit, and processing unit will be explained below.

Target Air-Fuel Ratio Setting Unit

Figure 6A:
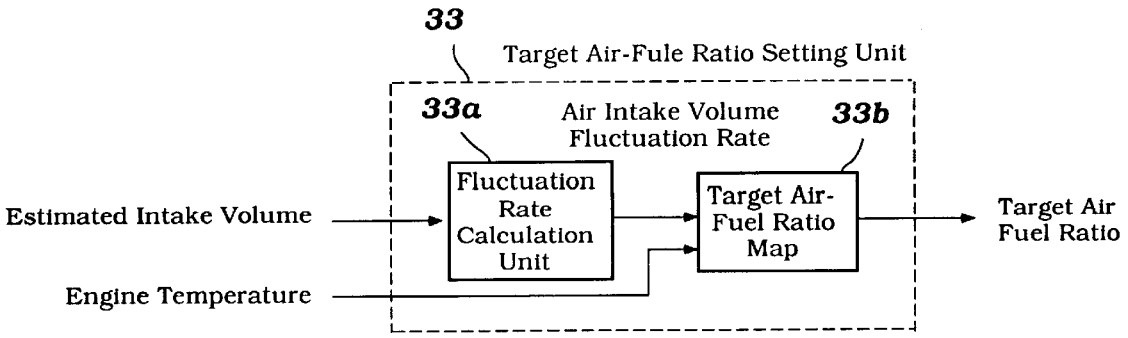
FIG. 6A is a schematic block diagram showing the structure of the target air-fuel ratio setting unit 33 illustrated in FIG. 5.
Figure 6B:
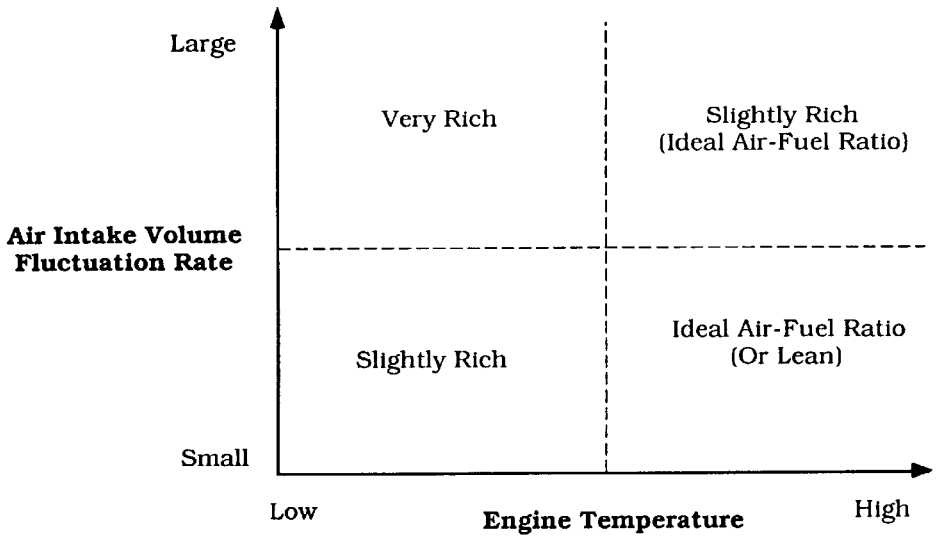
FIG. 6B is a target air-fuel ratio map.

FIG. 6A is a schematic block diagram showing the structure of the target air-fuel ratio setting unit 33 illustrated in FIG. 5. FIG. 6B is a target air-fuel ratio map. A changing rate calculation unit 33*a* calculates the changing rate of the estimated intake air quantity calculated at the intake air quantity calculation unit 30. Based on the changing rate of the estimated intake air quantity and the engine temperature, the target air-fuel ratio map 33*b* is referred to, thereby setting the air-fuel ratio as shown in FIG. 6B. During normal driving of the engine, the target air-fuel ratio is set at, for example, the theoretical air-fuel ratio. If the engine temperature is low or the engine is in a transition state, the target air-fuel ratio is programmed to change.

Internal Feedback Processing Unit

Figure 7:
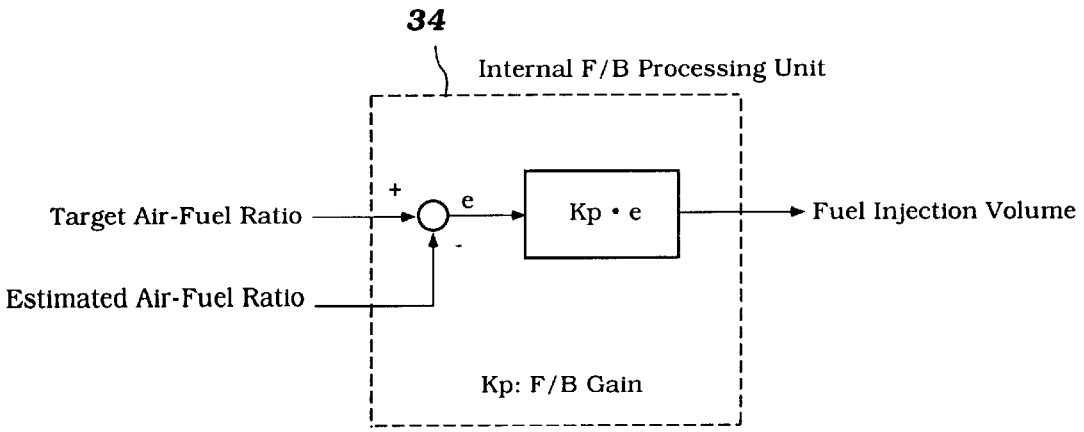
FIG. 7 is a schematic block diagram showing the structure of the internal feedback processing unit 34 indicated in FIG. 5.

FIG. 7 is a schematic block diagram showing the structure of the internal feedback processing unit 34 indicated in FIG. 5. In this embodiment, feedback control is conducted by multiplying a feedback gain Kp and a discrepancy between the target air-fuel ratio set as shown in FIG. 6 and the estimated air-fuel ratio calculated at the estimated air-fuel ratio calculation unit 32 described later. An output from the internal feedback processing unit is provided to the fuel injection valve 13 and the intake fuel calculation unit 31.

Learning Signal Calculation Unit

Figure 8:
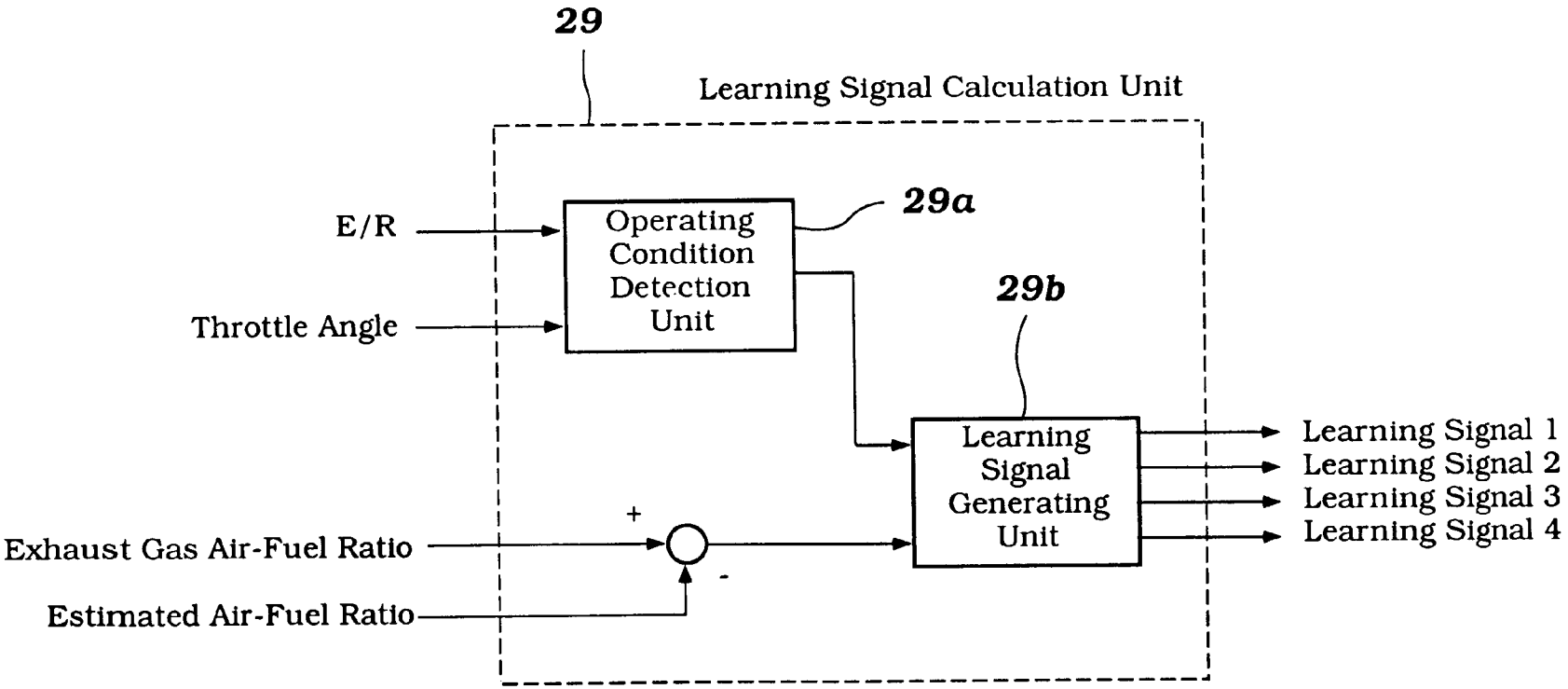
FIG. 8 is a schematic block diagram illustrating the structure of the learning signal calculation unit 29 indicated in FIG. 5.

FIG. 8 is a schematic block diagram illustrating the structure of the learning signal calculation unit 29 indicated in FIG. 5. At a driving condition detection unit 29*a*, driving conditions are calculated from the engine revolutions and the throttle angle. At a learning signal generation unit 29*b*, a discrepancy between the current exhaust air-fuel ratio and the estimated air-fuel ratio (described later) is determined in accordance with the detected driving conditions. Learning signals 1 and 2 are used as teacher data for the intake air quantity calculation to learn the intake air quantity. Learning signals 3 and 4 are used as teacher data for the intake fuel quantity calculation unit 31 indicated in FIG. 5 to learn the intake fuel quantity. All of learning signals 1–4 contain information of a discrepancy between the current exhaust air-fuel ratio and the estimated air-fuel ratio (hereinafter referred to as "A/F discrepancy"), but each corresponds to a different type of contribution to the A/F discrepancy when outputting a signal based on the A/F discrepancy. In this embodiment, there are types of contribution to the A/F discrepancy: (1) a discrepancy caused by an environmental change (e.g., a change in air density) around the engine including changes in intake temperature and ambient pressure; (2) a discrepancy caused by a change with elapsed time in the engine itself including a change in the timing of valving; (3) a discrepancy caused by a change in the evaporation time constant of fuel deposited on the wall of the intake pipe 6; and (4) a discrepancy caused by a change in the deposition rate of fuel deposited on the wall of the intake pipe 6. These discrepancies are modeled so as to determine teacher data based on the A/F discrepancy in accordance with each type of contribution to the A/F discrepancy.

Intake Air Quantity Calculation Unit

Figure 9:
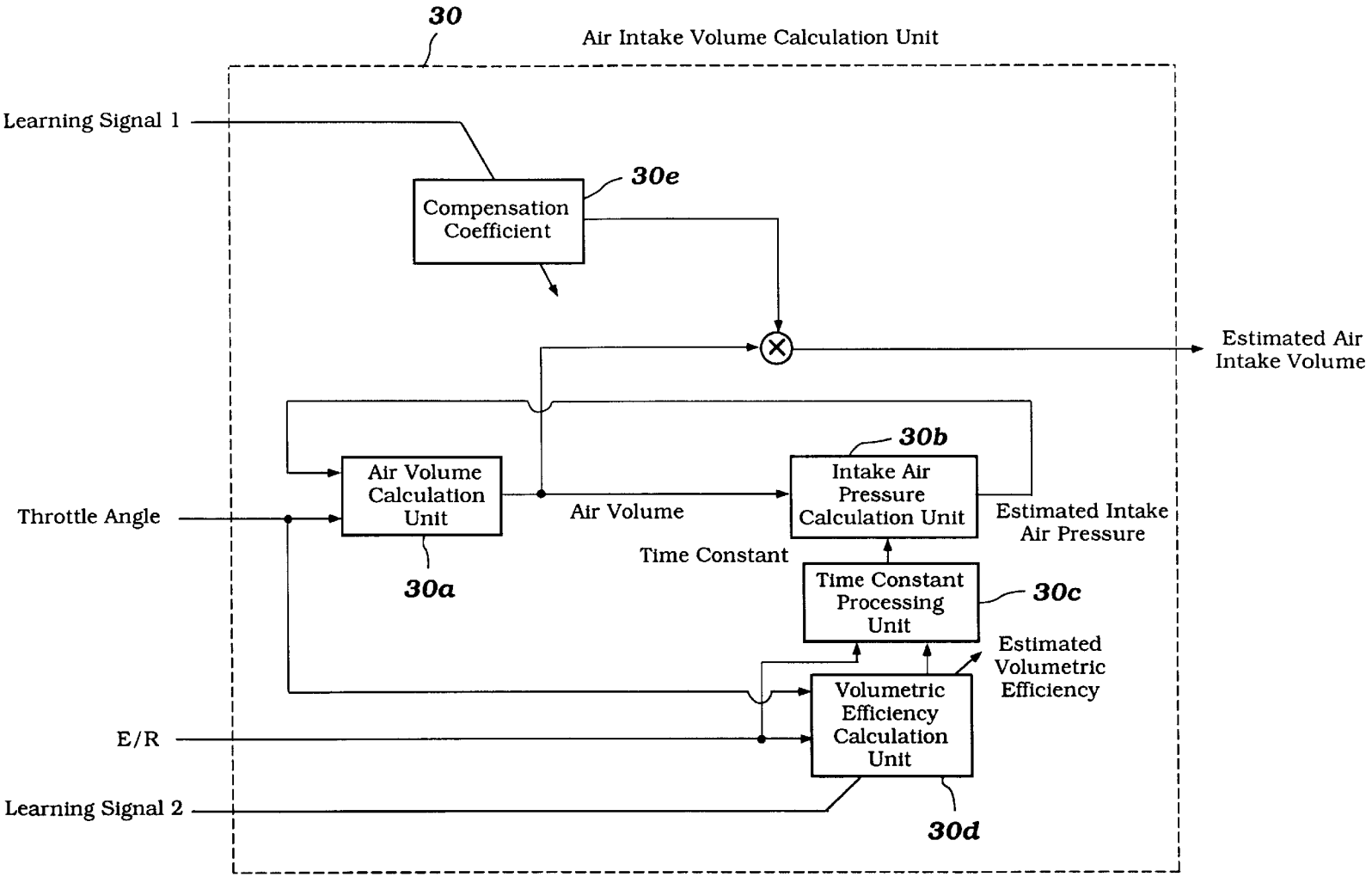
FIG. 9 is a schematic block diagram illustrating the structure of the intake air quantity calculation unit 30 indicated in FIG. 5.

FIG. 9 is a schematic block diagram illustrating the structure of the intake air quantity calculation unit 30 indicated in FIG. 5. The quantity of intake air passing through the throttle via the throttle opening is calculated at an air quantity calculation unit 30*a* based on equation (1):

$$\text{Air quantity Ma } (\alpha, \text{Pman}) = (\text{Ct}(\Pi/4)\text{D}^2(\text{Pamb}\sqrt{\text{k}})/(\sqrt{(\text{PTamb})}))\beta_1(\alpha)\beta_2(\text{Pman})+\text{Mao} \quad (1)$$

In the above, Ma is the quantity of air passing through the throttle, $\alpha$ is a throttle angle, Ct is a flow coefficient at the throttle, D is the diameter of the throttle, Pamb is the ambient pressure, k is the specific heat of air, Tamb is ambient temperature, R is a gas constant, Mao is a compensation variable, Pman is the intake pipe pressure (intake negative pressure), $\beta_1$ is a coefficient depending on the throttle angle, $\beta_2$ is a coefficient depending on the intake pipe pressure.

At a volumetric efficiency calculation unit 30*d*, an estimated volumetric efficiency (the volumetric ratio of air entering the cylinder to the volume of the cylinder) is calculated from the throttle angle and engine revolutions. At a time constant calculation unit 30*c*, a time constant is calculated from the calculated estimated volumetric efficiency and engine revolutions, based on equation (2). The change in the intake pressure occurs after a time period represented by a time constant after engine revolutions is changed in a transition state, and the time constant in a transition state must be determined.

$$\text{Time Constant } \tau = 120 \times V/n \cdot \eta \cdot Vd \quad (2)$$

In the above, V is the intake pipe volume, n is engine revolutions, η is the volumetric efficiency, Vd is the quantity of an exhaust gas.

At an intake pressure calculation unit 30*b*, the estimated intake pressure is calculated from the air quantity calculated at the air quantity calculation unit 30*a* and the time constant τ, based on equation (3).

Intake Pressure $$= P'man = (-1/\tau)(Pman(RTman/V))Ma(\alpha, Pman) \quad (3)$$

Tman is the temperature of the intake pipe.

Based on the calculated estimated intake pressure and the throttle angle, the intake air quantity is again calculated at the air quantity calculation unit 30*a*, and is outputted as an estimated intake air quantity. In the above, signal 1 containing information about the A/F discrepancy is used as teacher data for a compensation coefficient 30*e* to be updated, thereby modifying the estimated intake air quantity in order to compensate for the A/F discrepancy caused by a change in environment (e.g., a change in the air density).

Fuzzy Neural Network for Estimated Volumetric Efficiency

Figure 10:
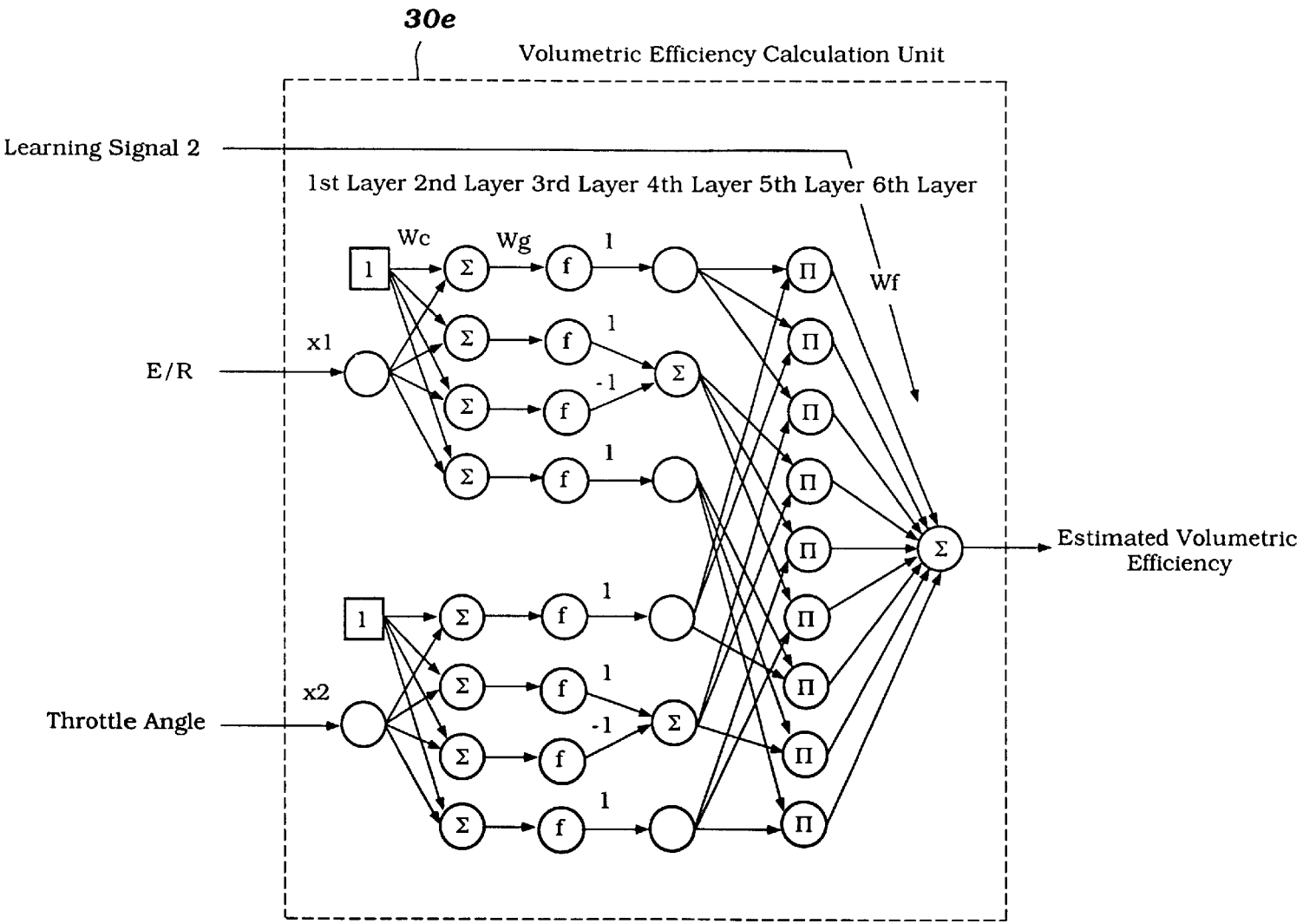
FIG. 10 is a schematic view illustrating a fuzzy neural network for estimating a volumetric efficiency at the volumetric efficiency calculation unit 30*d* indicated in FIG. 9.

FIG. 10 is a schematic view illustrating a fuzzy neural network for estimating a volumetric efficiency at the volumetric efficiency calculation unit 30*d* indicated in FIG. 9. The volumetric efficiency cannot be determined based on equations, and thus the volumetric efficiency is modeled using a fuzzy neural network. The fuzzy neural network comprises a hierarchical fuzzy neural network composed of six layers, wherein layers from a first layer through a fourth layer constitute a first-half portion (preceding portion), and layers from a fifth layer to a sixth layer constitute a second-half portion (subsequent portion). At the first-half portion, the engine revolutions and throttle angle inputted thereinto are subjected to fuzzy inference processing to determine to what degree they conform to given rules, and at the second-half portion, the estimated volumetric efficiency is determined based on the outcomes from the first-half portion by weighting the outcomes.

Figure 11:
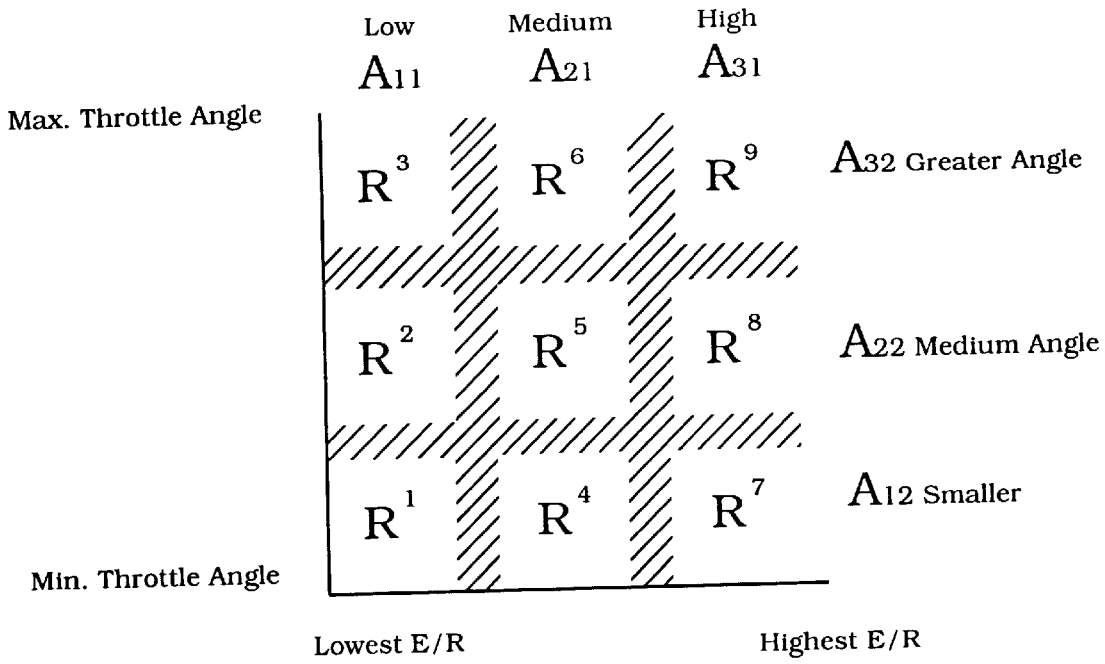
FIG. 11 is a schematic diagram showing the rule in the form of a map.

In this embodiment, the above rule comprises: three conditions for each input information, A11, A21, and A31 for engine revolutions, and A12, A22, and A32 for the throttle angle; and nine results R1–R9 corresponding to the conditions. FIG. 11 is a schematic diagram showing the rule in the form of a map. The vertical axis shows conditions A12, A22, and A32 for the throttle angle, and the horizontal axis shows conditions A11, A21, and A31 for engine revolutions. Nine segments (regions) two-dimensionally divided by each condition for the throttle angle and each condition for engine revolutions, show results R1–R9.

In the above, conditions A11, A21, and A31 denote that engine revolutions is in a "low range", "intermediate range", and "high range", respectively. Conditions A12, A22, and A32 denote that the throttle opening is "small", "intermediate", and "large", respectively. Results R1–R9 denote the estimated volumetric efficiency corresponding to the engine revolutions and the throttle angles. According to the above rules and conditions, nine principles can be created, e.g., "when engine revolutions is in an intermediate range, and the throttle angle is in an intermediate range, the estimated volumetric efficiency is 60%", and "when engine revolutions is in a high range, and the throttle angle is in a high range, the estimated volumetric efficiency is 100%."

The layers from the first layer through the fourth layer, constituting the preceding portion, are divided into two processing processes, one for engine revolutions, and the other for the throttle angle. At the first layer, each of the engine revolutions signal and the throttle angle signal is inputted as input signal xi (i=1 or 2), and at the second layer through the fourth layer, contribution aij of each input signal xi is determined for each of conditions A11, A21, A31, A12, A22, and A32. That is, contribution aij can be calculated using a sigmoid equation f(xi) indicated below as equation (4):

$$\text{Contribution } aij = f(xi) = 1/(1 + \exp(-wg(xi + wc))) \quad (4)$$

In the above equation, wg and wc are coefficients related to the inclination and the central value of the sigmoid equation, respectively.

Based on the sigmoid equation, after contribution aij of each input signal xi (engine revolutions signal and throttle angle signal) is determined for each of conditions A11, A21, A31, A12, A22, and A32 at the fourth layer, conformity $\mu i$ is determined at the fifth layer, based on contribution aij, for each of nine results R1–R9 regarding the inputted engine revolutions signal and throttle angle, using equation (5). Further, conformity $\mu i$ (i=1–9) is normalized to obtain a normalized conformity using equation (6). At the sixth layer, the estimated volumetric efficiency Ve is determined by using a weighted mean of the normalized conformity for each result obtained by equation (6) and each output fi of fuzzy rules (i.e., output corresponding to each of results R1–R9), using equation (7).

Conformity $\mu i$=

$$\text{Conformity } \mu i = \prod_j jaij \quad (5)$$

$$\text{Normalized Conformity } \mu' i = \mu i \Big/ \sum_k \mu k \quad (6)$$

$$\text{Estimated Volumetric efficiency } Ve = \sum_i \mu' i f i \quad (7)$$

The fuzzy neural network indicated in FIG. 10 is simply one example, and engine revolutions or the throttle angle can be divided into more detailed conditions, i.e., more than nine results, thereby determining the estimated volumetric efficiency accordingly.

In the above, the volumetric efficiency calculation unit 30*d* has a learning function. Using the learning function, in the beginning, the unit undergoes the learning of the fuzzy neural network by correcting parameter Wf (a coupling coefficient indicating output fi of the fuzzy rules) in such a way that the difference between the experimentally obtained volumetric efficiency and the volumetric efficiency outputted from the fuzzy neural network is minimized. Thereafter, by undergoing learning by the fuzzy neural network, coupling coefficient Wf is updated in such a way as to minimize the value of learning signal 2, i.e., the A/F discrepancy.

Intake Fuel Calculation Unit

Figure 12:
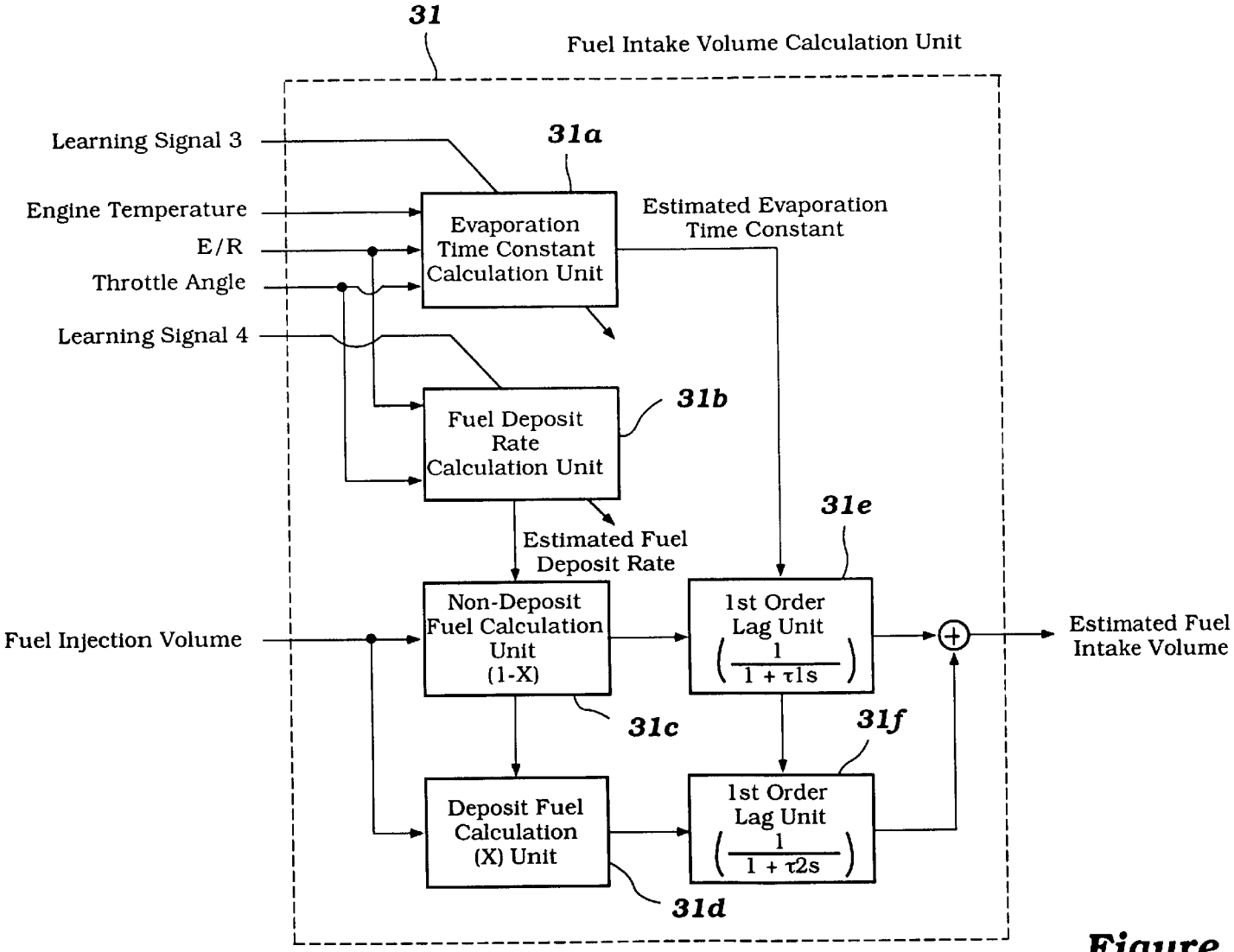
FIG. 12 is a schematic block diagram illustrating the learning model of the intake fuel calculation unit 31 indicated in FIG. 5.

FIG. 12 is a schematic block diagram illustrating the learning model of the intake fuel calculation unit 31 indicated in FIG. 5. The evaporation time constant calculation unit 31*a* calculates the time constant τ for vaporization of fuel deposited on a wall of the intake pipe 6, based on the engine temperature, engine revolutions, and the throttle angle. The fuel deposition calculation unit 31*b* calculates the ratio (the deposition ratio x) of the fuel deposited on a wall of the intake pipe 6 and throttle valve 12 to the fuel injected, based on engine revolutions and the throttle angle. A non-deposition fuel calculation unit 31*c* calculates the quantity of fuel directly entering into the combustion chamber 5 out of the quantity of fuel according to the input signal, based on the aforesaid calculated fuel deposition ratio x. A deposition fuel calculation unit 31*d* calculates the quantity of fuel deposited on the wall of the intake pipe 6 out of the quantity of fuel according to the input signal, based on the aforesaid calculated fuel deposition ratio x. The quantities of fuel calculated at the non-deposition fuel calculation unit 31*c* and the deposition fuel calculation unit 31*d* are approximated to a first-order lag system at first-order lag units 31*e* and 31*f* based on estimated evaporation time constants τ1, τ2 calculated at the evaporation time constant calculation unit 31*a*. Thereafter, the quantities are added, and outputted as an estimated intake fuel quantity.

Figure 13:
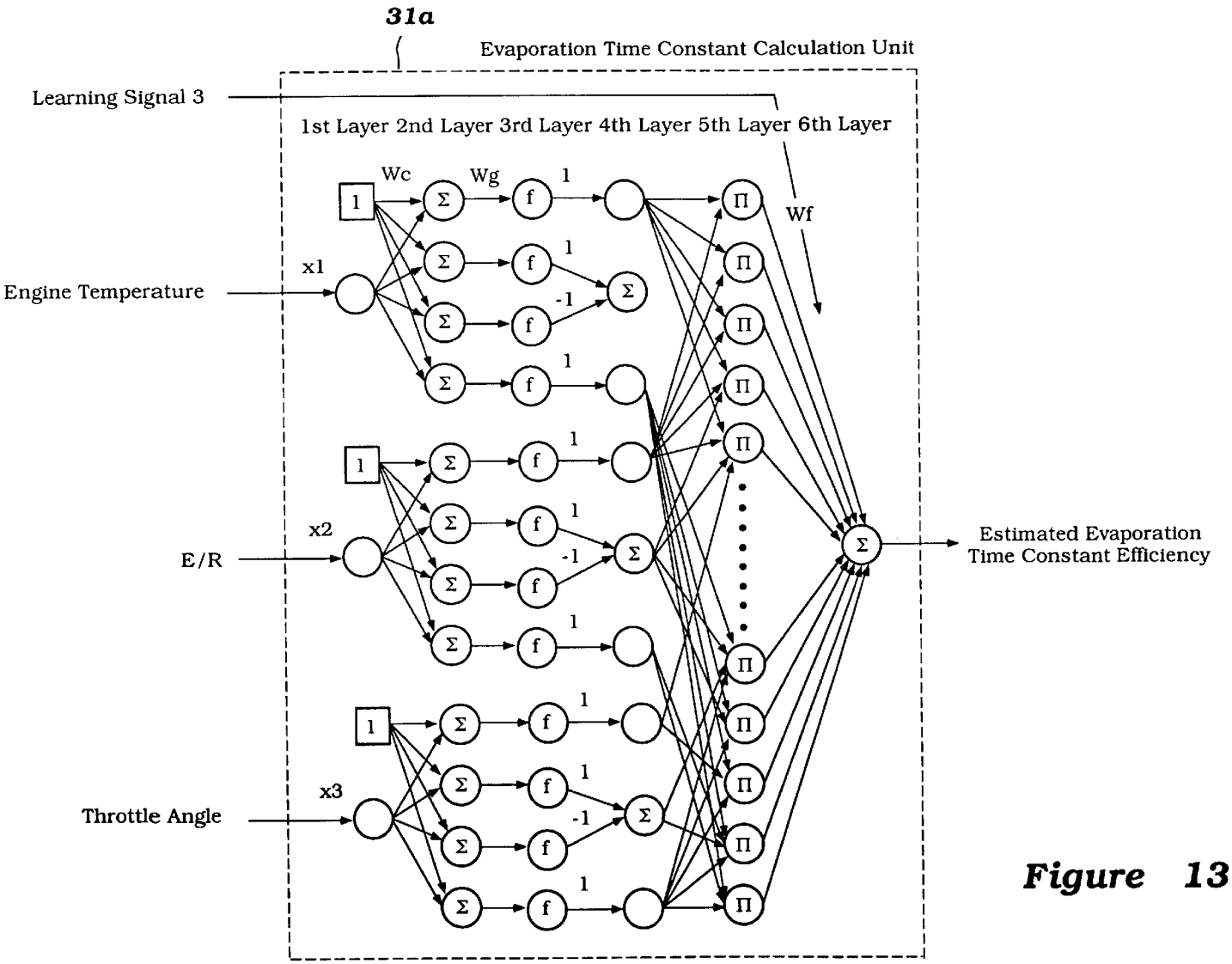
FIG. 13 is a schematic view illustrating a fuzzy neural network for estimating an evaporation time constant at the evaporation time constant calculation unit 31*a* indicated in FIG. 12.

FIG. 13 is a schematic view illustrating a fuzzy neural network for estimating an evaporation time constant at the evaporation time constant calculation unit 31*a* indicated in FIG. 12. The basic structure and principle of this fuzzy neural network are the same as those illustrated with reference to FIGS. 9 and 10 for the volumetric efficiency, and thus explanation will be omitted. However, for calculation of the estimated evaporation time constant, three signals xi, i.e., the engine temperature, engine revolutions, and the throttle angle, are inputted. If three conditions are set for engine temperature, A13, A23, and A33, the neural network is conducted based on a combination of total 9 driving conditions and 27 conclusions. This evaporation time constant calculation unit 31*a* has a learning function. Using the learning function, in the beginning, the unit undergoes the learning of the fuzzy neural network by correcting parameter Wf (a coupling coefficients indicating output fi of the fuzzy rules) in such a way that the difference between the experimentally obtained evaporation time constant and the evaporation time constant outputted from the fuzzy neural network is minimized. Thereafter, by undergoing learning by the fuzzy neural network, coupling coefficient Wf is updated in such a way as to minimize the value of learning signal 3, i.e., the A/F discrepancy.

Also, at the fuel deposition calculation unit 31*b* indicated in FIG. 12, the estimated fuel deposition ratio is calculated using the fuzzy neural network, and by undergoing learning by the fuzzy neural network, coupling coefficient Wf is updated in such a way as to minimize the value of learning signal 4, i.e., the A/F discrepancy.

Overall Effects

In the above, when the estimated intake air quantity Ae and the estimated intake fuel quantity Fe are calculated, the estimated air-fuel ratio is calculated based on the Ae/Fe at the estimated air-fuel ratio calculation unit 32 indicated in FIG. 5. The signal of the estimated air-fuel ratio is provided to the aforesaid learning signal calculation unit 29, as well as to the internal feedback processing unit 34. The signal of the estimated intake air quantity is provided to the target air-fuel ratio calculation unit 33.

As described above, in this embodiment, the estimated air-fuel ratio is determined by calculating the estimated intake air quantity and the estimated intake fuel quantity, and the estimated air-fuel ratio is compared with the actual air-fuel ratio in the exhaust. The control is conducted in such a way as to minimize the discrepancy between the estimated air-fuel ratio and the actual air-fuel ratio in the exhaust, by outputting learning signals. Accordingly, accurate control over the air-fuel ratio can be achieved by simple control using a minimum number of sensors.

Second Embodiment

Figure 14:
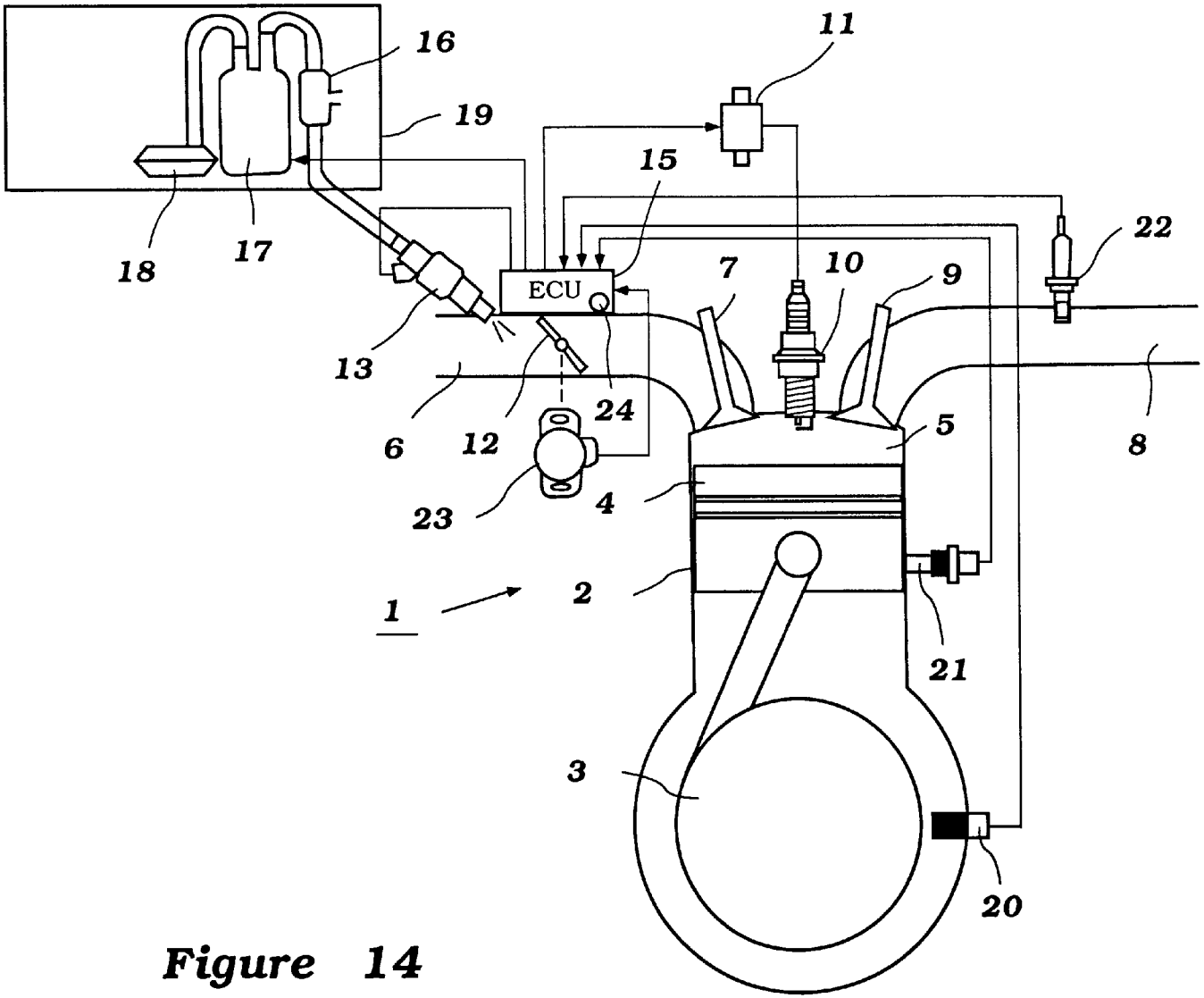
FIG. 14 is a schematic diagram of an engine including a second embodiment of the injection control system according to the present invention.
Figure 15:
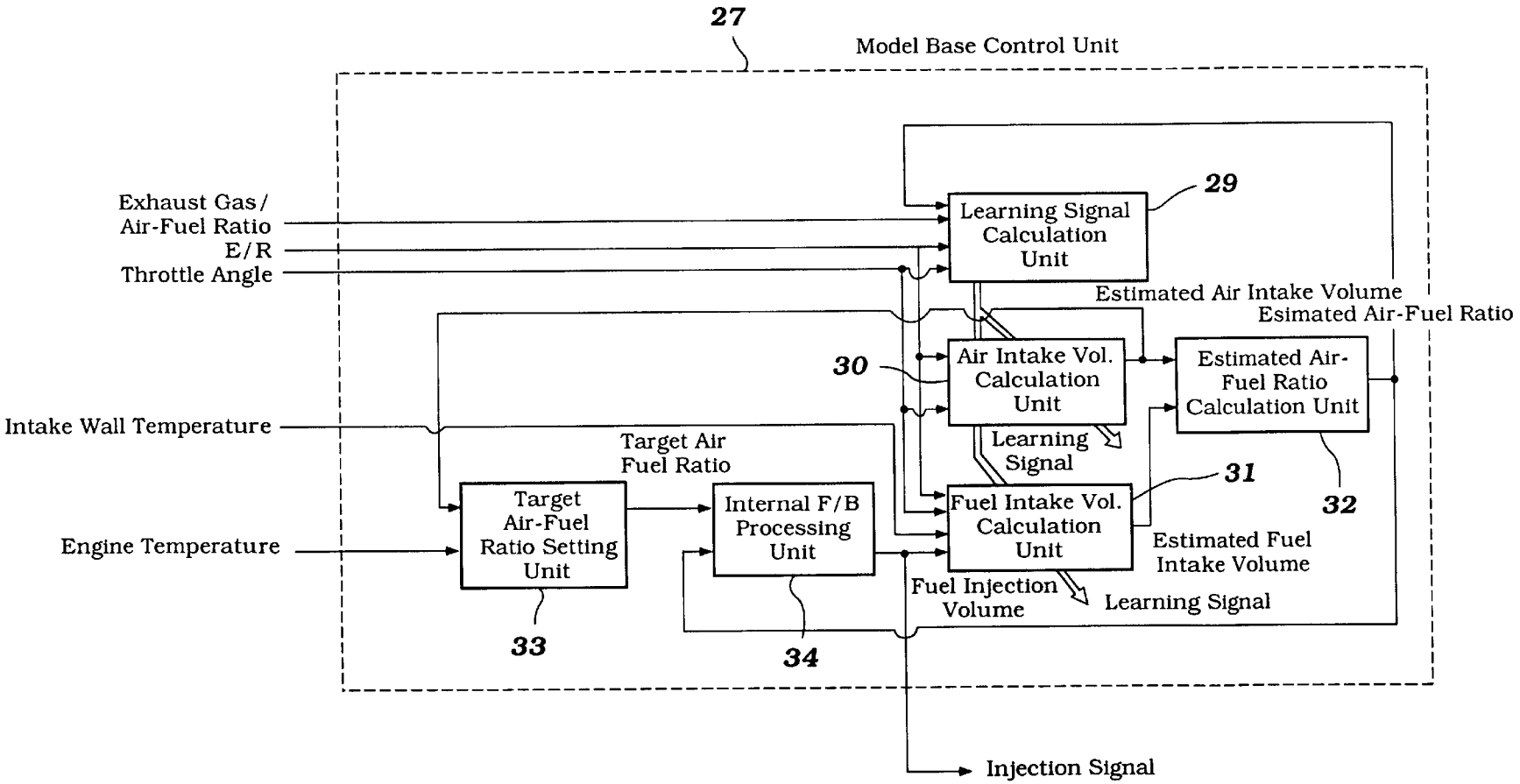
FIG. 15 is a schematic block diagram illustrating the structure of the model-based control unit 27 indicated in FIG. 4.

FIGS. 13 and 14 illustrate another embodiment of the fuel injection control for an engine according to the present invention. FIG. 14 is a schematic diagram of an engine, and FIG. 15 is a schematic block diagram illustrating the structure of the model-based control unit 27 indicated in FIG. 4. In the first embodiment, in order to determine the temperature of the intake pipe 6, the temperature of the engine 1 itself is detected, thereby calculating the estimated intake fuel quantity, whereas, in FIG. 14, an engine temperature detector 24 for directly detecting the temperature of a wall of the intake pipe is disposed inside the control device 15 which is installed on a wall of the intake pipe 6. As shown in FIG. 15, at the intake fuel calculation unit 31, the estimated intake fuel quantity is calculated based on the temperature of the intake pipe, instead of the temperature of the engine itself. The structures in FIG. 15, except for the intake fuel quantity calculation unit 31, are the same as those described in the first embodiment, and thus explanation will be omitted. In this embodiment, by directly detecting the temperature of the intake pipe, the estimated intake fuel quantity can be calculated more accurately, thereby performing the air-fuel ratio control with higher accuracy.

Third Embodiment

Figure 16:
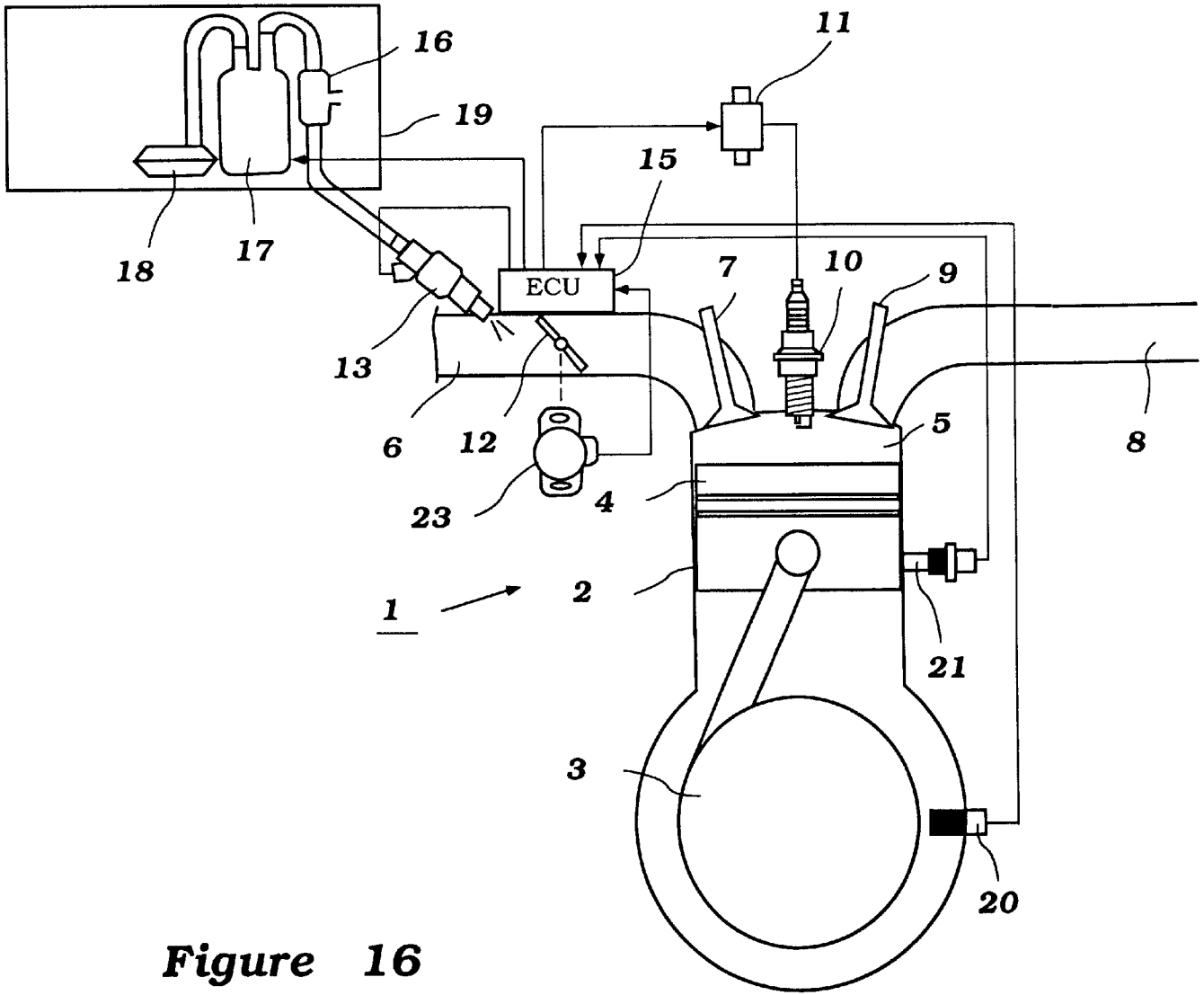
FIG. 16 is a schematic view illustrating the structure of an engine including a third embodiment of the injection control system according to the present invention.
Figure 17:
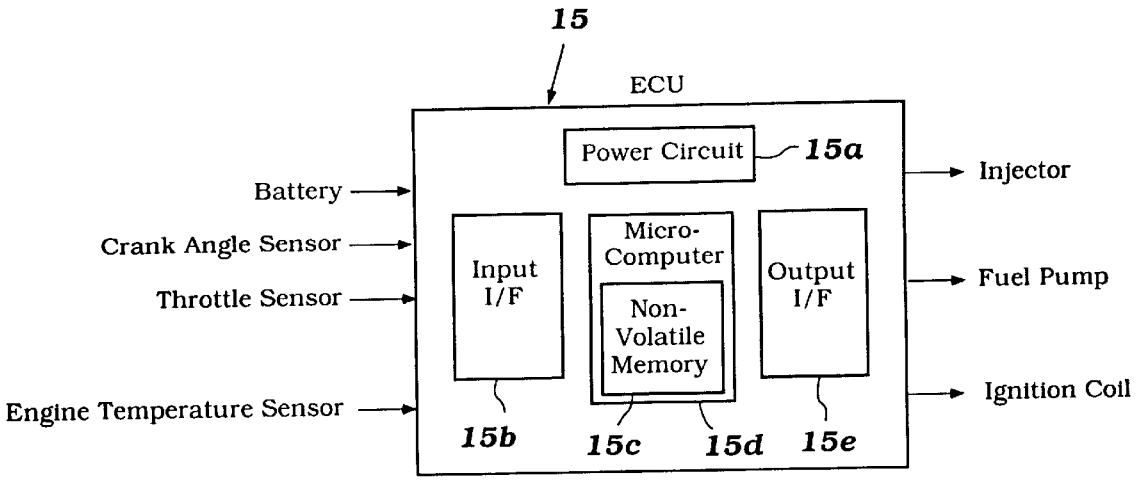
FIG. 17 is a schematic view illustrating the structure of the controller 15 indicated in FIG. 16.
Figure 18:
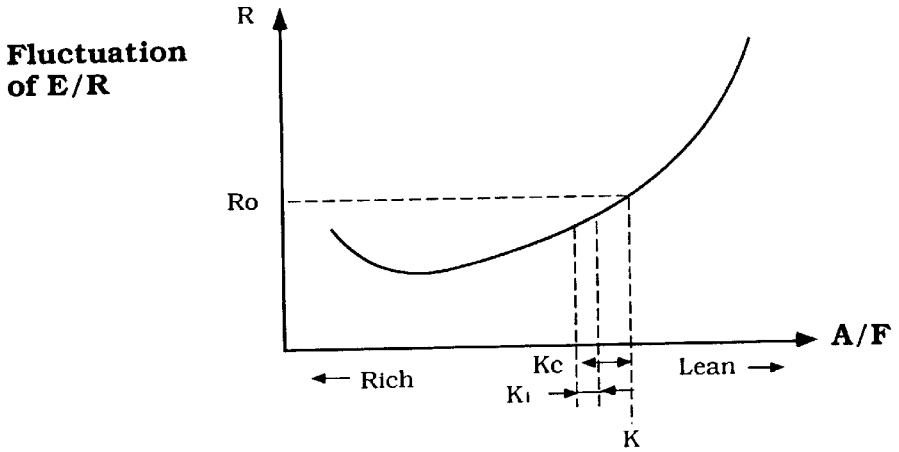
FIG. 18 is a schematic graph showing the relationship between air-fuel ratios and revolution fluctuations of the crank shaft 3.

FIGS. 15–23 illustrate a third embodiment of the fuel injection control device according to the present invention. In the figures, the elements which are the same as those in FIGS. 1–12 have the same numerals, and explanation will be omitted. FIG. 16 is a schematic view illustrating the structure of an engine, and FIG. 17 is a schematic view illustrating the structure of the controller 15 indicated in FIG. 16. In this embodiment, the air-fuel sensor 22 indicated in FIG. 2 is omitted, thereby further simplifying the structures. FIG. 18 is a schematic graph showing the relationship between air-fuel ratios and revolution fluctuations of the crank shaft 3. When the A/F changes to a fuel-lean state and exceeds a predetermined value K, revolution fluctuation of the engine (the crank shaft 3) exceeds a predetermined point $R_0$. Accordingly, in this embodiment, the engine is driven in a fuel-lean state as much as possible, and when the revolution fluctuation exceeds $R_0$, the engine is controlled in such a way that the air-fuel ratio K is shifted to a fuel-rich state.

Control Unit

Figure 19:
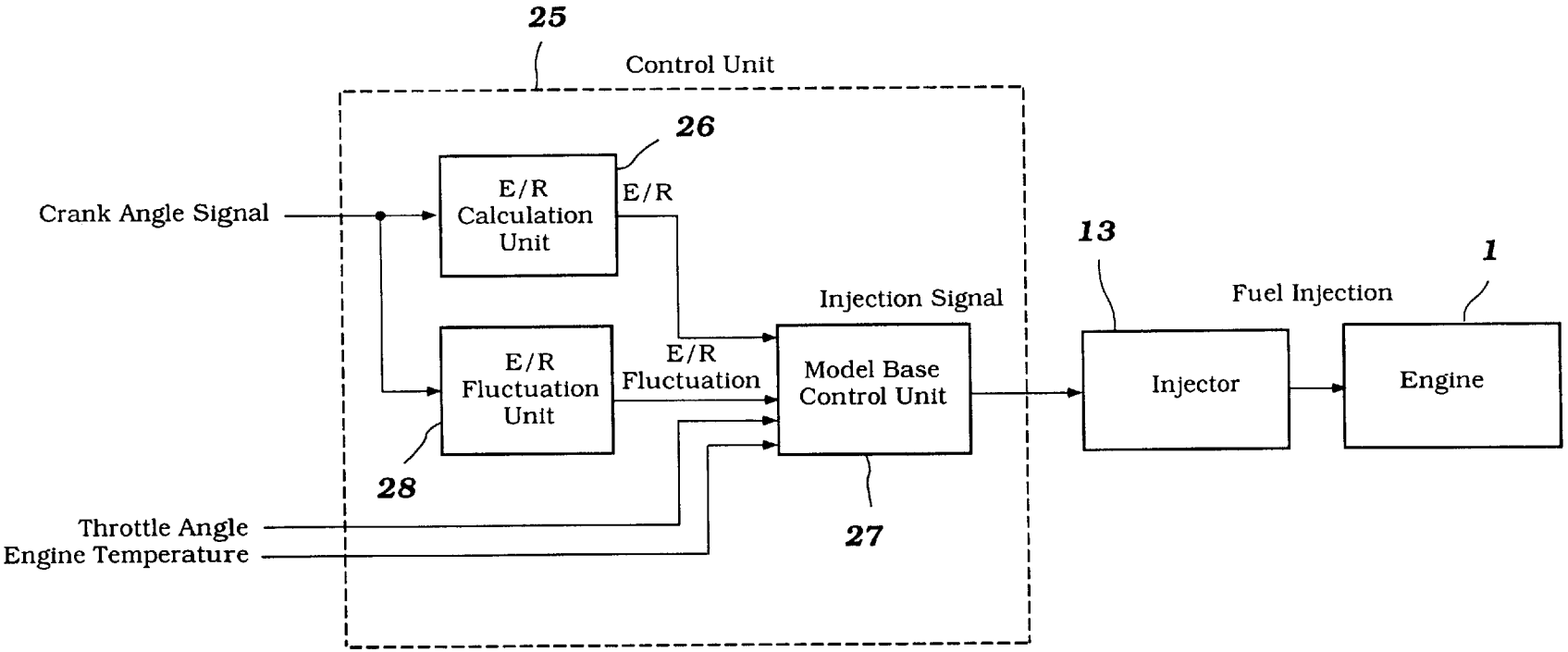
FIG. 19 is a schematic block diagram of a control unit regulating the injector, which control is processed in the microcomputer 15*d* of FIG. 17.

FIG. 19 is a schematic block diagram of a control unit regulating the injector, which control is processed in the microcomputer 15*d* of FIG. 17. In this embodiment, as compared with that indicated in FIG. 4, a revolution fluctuation calculation unit 28 is provided for calculating the revolution fluctuation of the crank shaft 3 based on the crank angle signal, and output of the revolution fluctuation calculation unit 28, instead of the air-fuel ratio in the exhaust, is inputted into the model-based controller 27.

Revolution Fluctuation Calculation Unit

Figure 20:
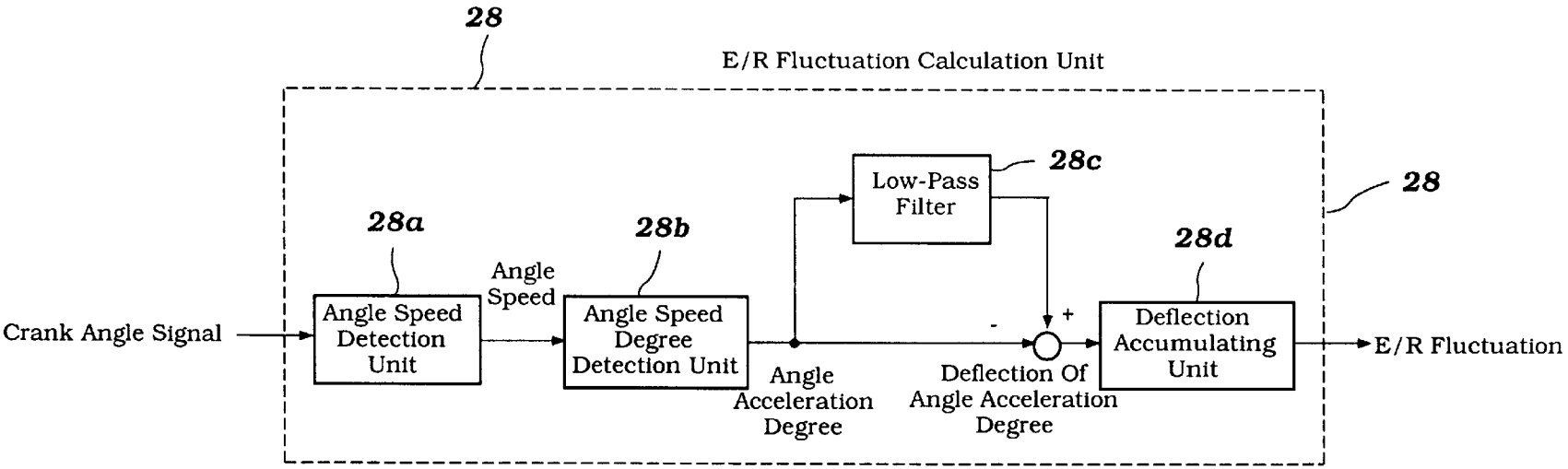
FIG. 20 is a schematic view illustrating the structure of the revolution fluctuation calculation unit 28 indicated in FIG. 19.

FIG. 20 is a schematic view illustrating the structure of the revolution fluctuation calculation unit 28 indicated in FIG. 19. At an angular velocity detection unit 28*b*, the angular acceleration is detected based on the angular velocity. The angular acceleration signal diverges into two passes, one passing through a low-pass filter 28*c*, the other going straight, and they meet to determine an angular velocity deviation therebetween. The angular acceleration deviation is accumulated at a deviation accumulation unit 28. When the accumulated angular acceleration exceeds a threshold, a revolution fluctuation signal is outputted.

Model-Based Control Unit

Figure 21:
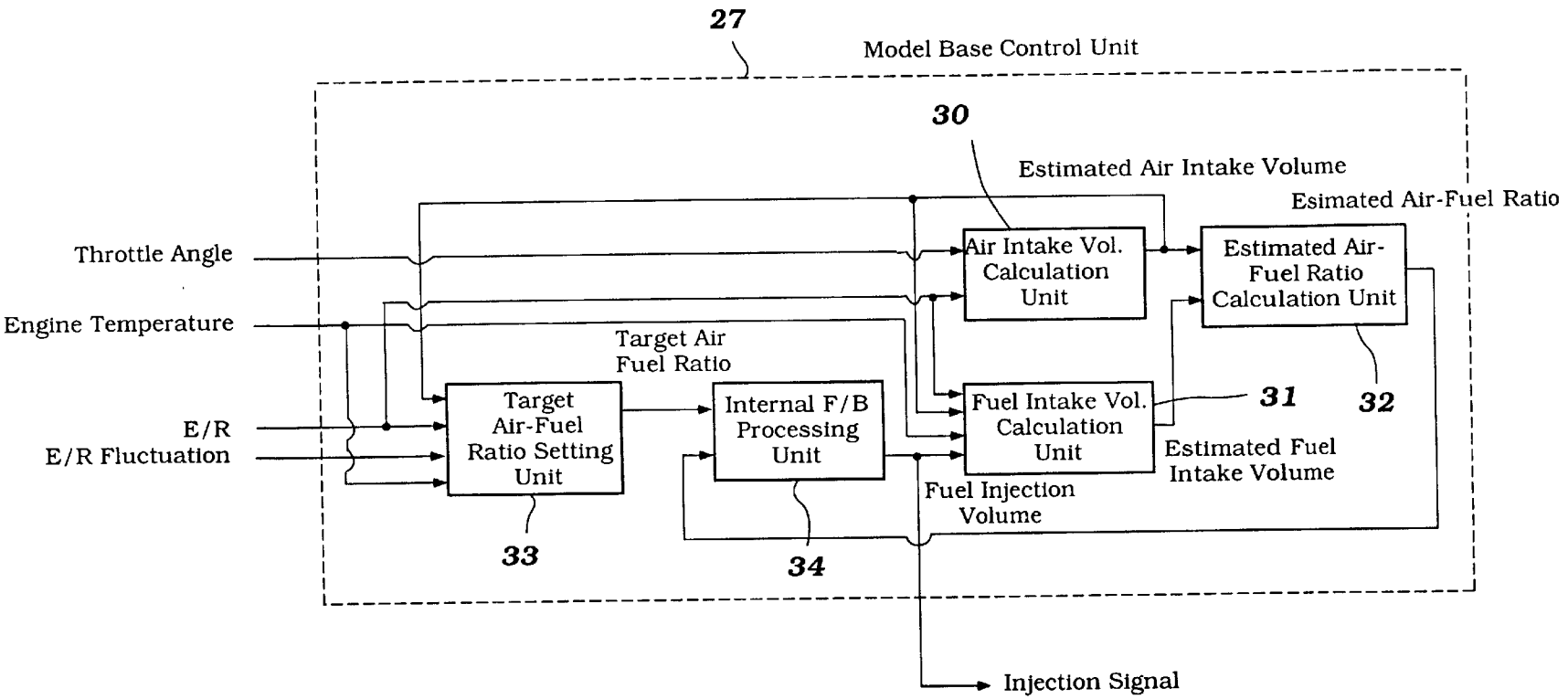
FIG. 21 is a schematic block diagram showing the structure of the model-based control unit 27 of FIG. 19.

FIG. 21 is a schematic block diagram showing the structure of the model-based control unit 27 of FIG. 19. In this embodiment, the learning signal calculation unit 29 indicated in FIG. 5 is omitted. Accordingly, the intake air quantity calculation unit 30 and the intake fuel quantity calculation unit 31 do not receive a learning signal, and the intake fuel quantity calculation unit 31 receives a signal of the estimated intake air quantity, instead of a signal of the throttle angle. In this embodiment, the intake air quantity calculation unit 30 and the intake fuel quantity calculation unit 31 may have the same structure as in the first embodiment without teacher data update. For example, regarding signals 2–4 in FIG. 8, these signals may be omitted, and a compensation value 30*e* in FIG. 9 may be omitted 1. However, to determine the estimated intake air quantity and the estimated fuel quantity, the unit may not need to include fuzzy neural networks. They are usually undeterminable by equations due to dead time and high-order lags as described earlier, but if a control map is used, the estimated intake air quantity and the estimated fuel quantity can be determined without neural networks, based on analogy to the structure indicated in FIGS. 5A and 5B. The estimated air-fuel ratio calculation unit 32 and the internal feedback processing unit 34 are the same as those in FIG. 5. The target air-fuel ratio calculation unit 33 receives the temperature of the engine, the estimated intake air quantity, and engine revolutions, and further receives a signal of the aforesaid revolution fluctuation as teacher data. That is, the target air-fuel ratio is changeably set in accordance with the revolution fluctuation of the engine.

Target Air-Fuel Ratio Setting Unit

Figure 22:
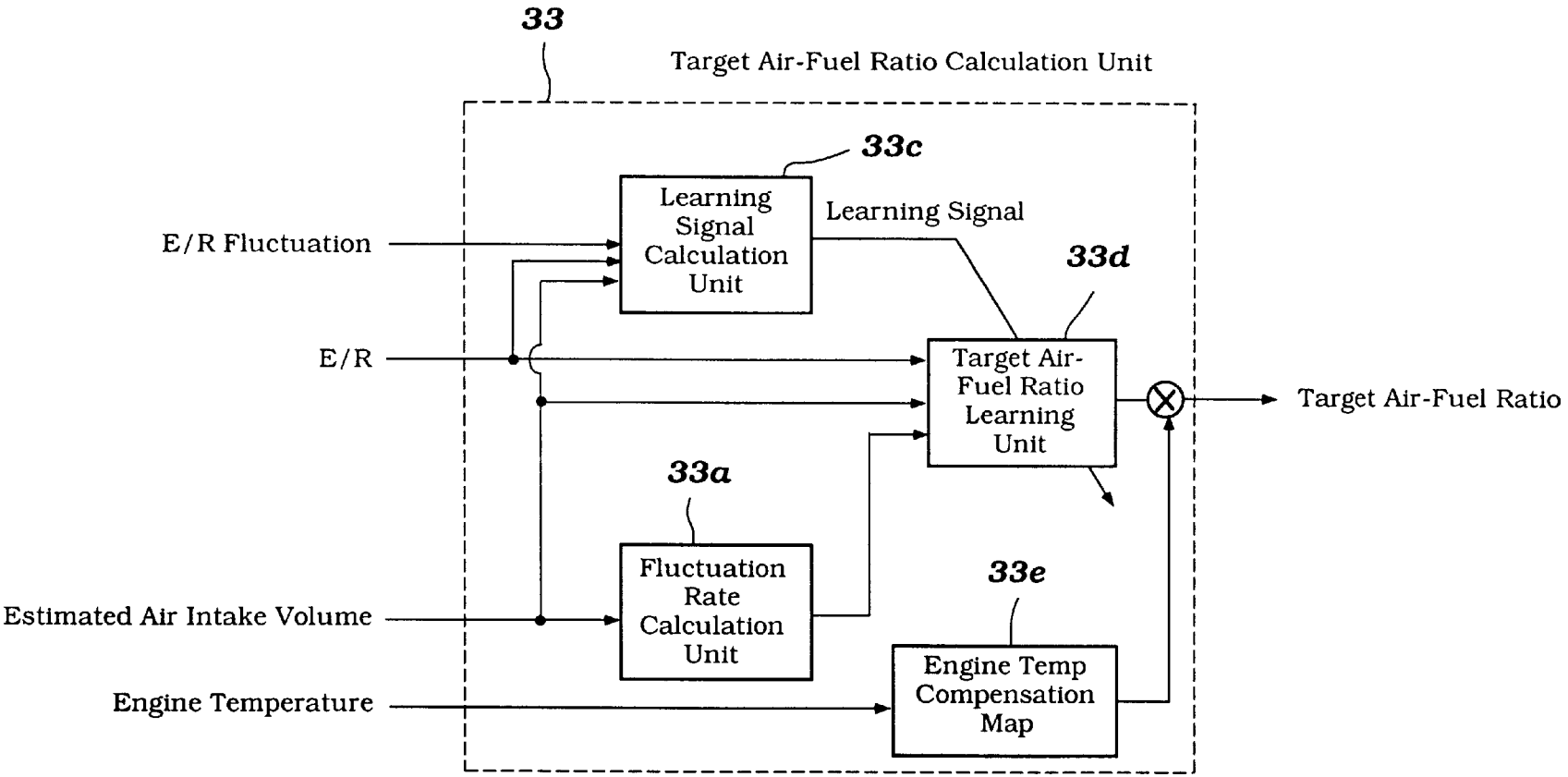
FIG. 22 is a schematic block diagram showing the structure of the target air-fuel ratio setting unit 33 illustrated in FIG. 21.

FIG. 22 is a schematic block diagram showing the structure of the target air-fuel ratio setting unit 33 illustrated in FIG. 21. The learning signal calculation unit 33*c* outputs a signal, as a learning signal, in accordance with the aforesaid revolution fluctuation, and the signal is used as teacher data at the target air-fuel ratio learning unit 33*d* in order to undergo learning the target air-fuel ratio. The target air-fuel ratio learning unit 33*d* receives signals of engine revolutions, the estimated intake air quantity calculated at the intake air quantity calculation unit 30, and the estimated intake air quantity changing rate calculated at a changing rate calculation unit 33*a*, thereby calculating the target air-fuel ratio. Further, the target air-fuel ratio is modified based on the signal compensated for at an engine temperature compensation map 33*e*.

Fuzzy Neural Network for Estimated Volumetric Efficiency

Figure 23:
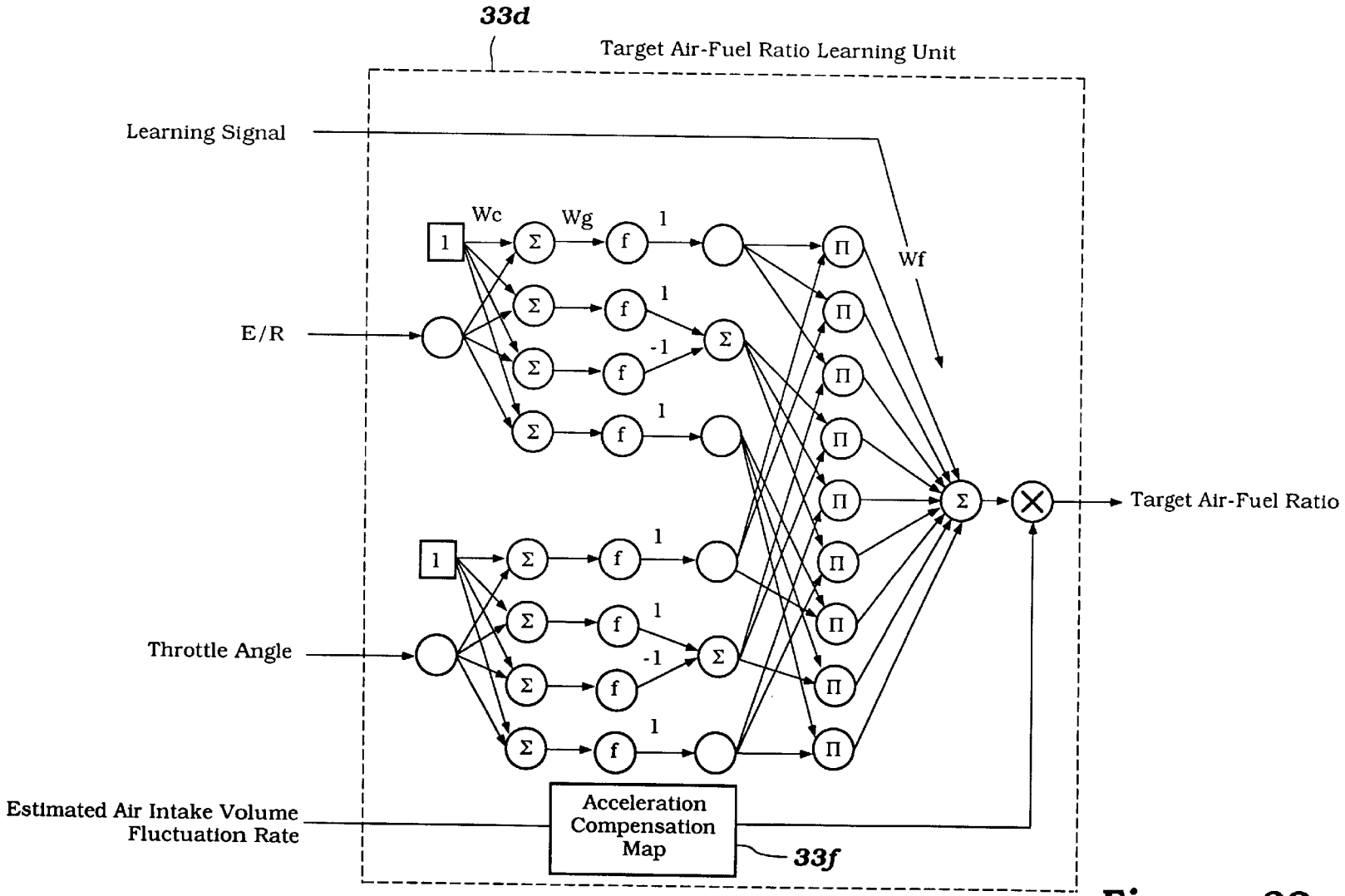
FIG. 23 is a schematic view illustrating a fuzzy neural network for estimating a target air-fuel ratio at the target air-fuel ratio learning unit 33*d* indicated in FIG. 22.

FIG. 23 is a schematic view illustrating a fuzzy neural network for estimating a target air-fuel ratio at the target air-fuel ratio learning unit 33*d* indicated in FIG. 22. The basic structure and principle of this fuzzy neural network are the same as those illustrated with reference to FIGS. 9 and 10 for the volumetric efficiency, and thus explanation will be omitted.

After the target air-fuel ratio is calculated based on engine revolutions and the estimated intake air quantity, a compensation coefficient is set using an acceleration compensation map in accordance with the estimated intake air quantity changing rate. The target air-fuel ratio is adjusted based on the calculated compensation coefficient. In this embodiment, driving conditions A11, A21, and A31 denote that engine revolutions is in a "low range", "intermediate range", and "high range", respectively. Driving conditions A12, A22, and A32 denote that the estimated intake air quantity is "small", "intermediate", and "large", respectively. Results R1–R9 denote the target air-fuel ratio corresponding to the engine revolutions and the estimated intake air quantity. According to the above rules and conditions, nine principles can be created, e.g., "when engine revolutions is in an intermediate range, and the estimated intake air quantity is in an intermediate range, the target air-fuel ratio is 14.5", and "when engine revolutions is in a high range, and the estimated intake air quantity is in a high range, the target air-fuel ratio is 12." In the above, the target air-fuel ratio learning unit 33*d* has a learning function. Using the learning function, in the beginning, the unit undergoes the learning of the fuzzy neural network by correcting coupling coefficient Wf in such a way that the target air-fuel ratio is controlled at a theoretical air-fuel ratio in all ranges. Thereafter, by undergoing learning by the fuzzy neural network, coupling coefficient Wf is updated in such a way as to minimize the value of the learning signal, i.e., the revolution fluctuation discrepancy.

Figure 24:
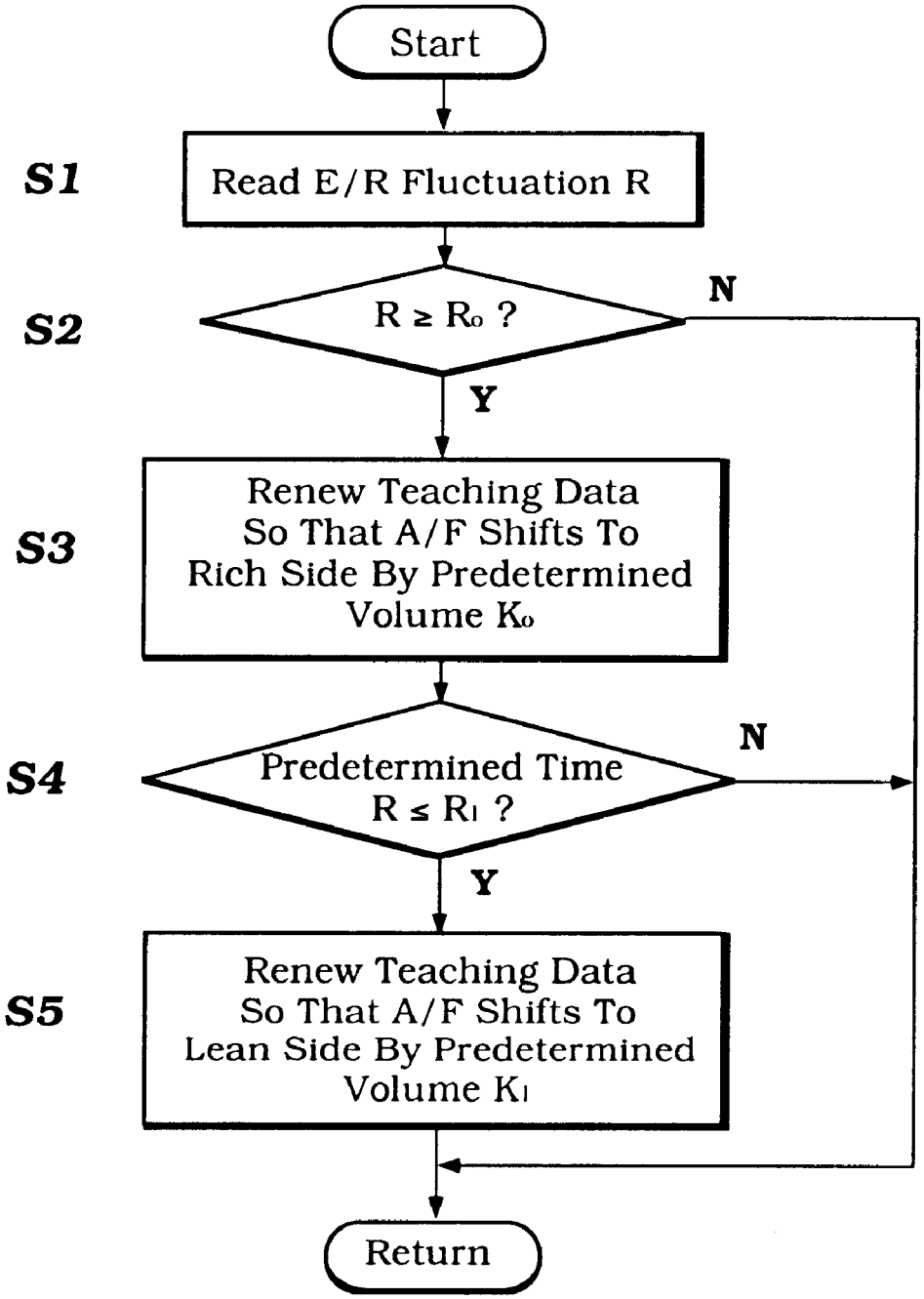
FIG. 24 is a flow chart for learning the target air-fuel ratio indicated in FIG. 23.

FIG. 24 is a flow chart for learning the target air-fuel ratio indicated in FIG. 23. This flow is explained with reference to FIG. 18. In step S1, the revolution fluctuation of the crank shaft 3 is read. In step S2, it is determined whether the revolution fluctuation exceeds a predetermined value $R_0$. In step S3, if the revolution fluctuation exceeds the value, the teacher data are updated in such a way that the A/F is shifted to a fuel-rich state by a given value $K_0$, thereby updating coupling coefficient Wf. By this control, the air-fuel ratio is shifted to a fuel-rich state. In step S4, it is determined whether the revolution fluctuation is lower than a predetermined value $R_1$. In step S5, if the value is lower, the teacher data are updated in such a way that the A/F is shifted to a fuel-lean state by a given value $K_1$, thereby updating coupling coefficient Wf. By this control, the air-fuel ratio is shifted to a fuel-lean state, and it is possible to drive the engine in a fuel state which is as lean as possible, and if the revolution fluctuation exceeds the predetermined value, the driving conditions are shifted to a fuel-rich state.

In addition, in this embodiment, as explained with reference to FIGS. 13 and 14, the engine temperature detector 24 for directly detecting the temperature of a wall of the intake pipe can be disposed inside the control device 15 which is installed on a wall of the intake pipe 6. At the intake fuel calculation unit 31, the estimated intake fuel quantity can be calculated based on the temperature of the intake pipe, instead of the temperature of the engine itself.

Fourth Embodiment

Figure 25:
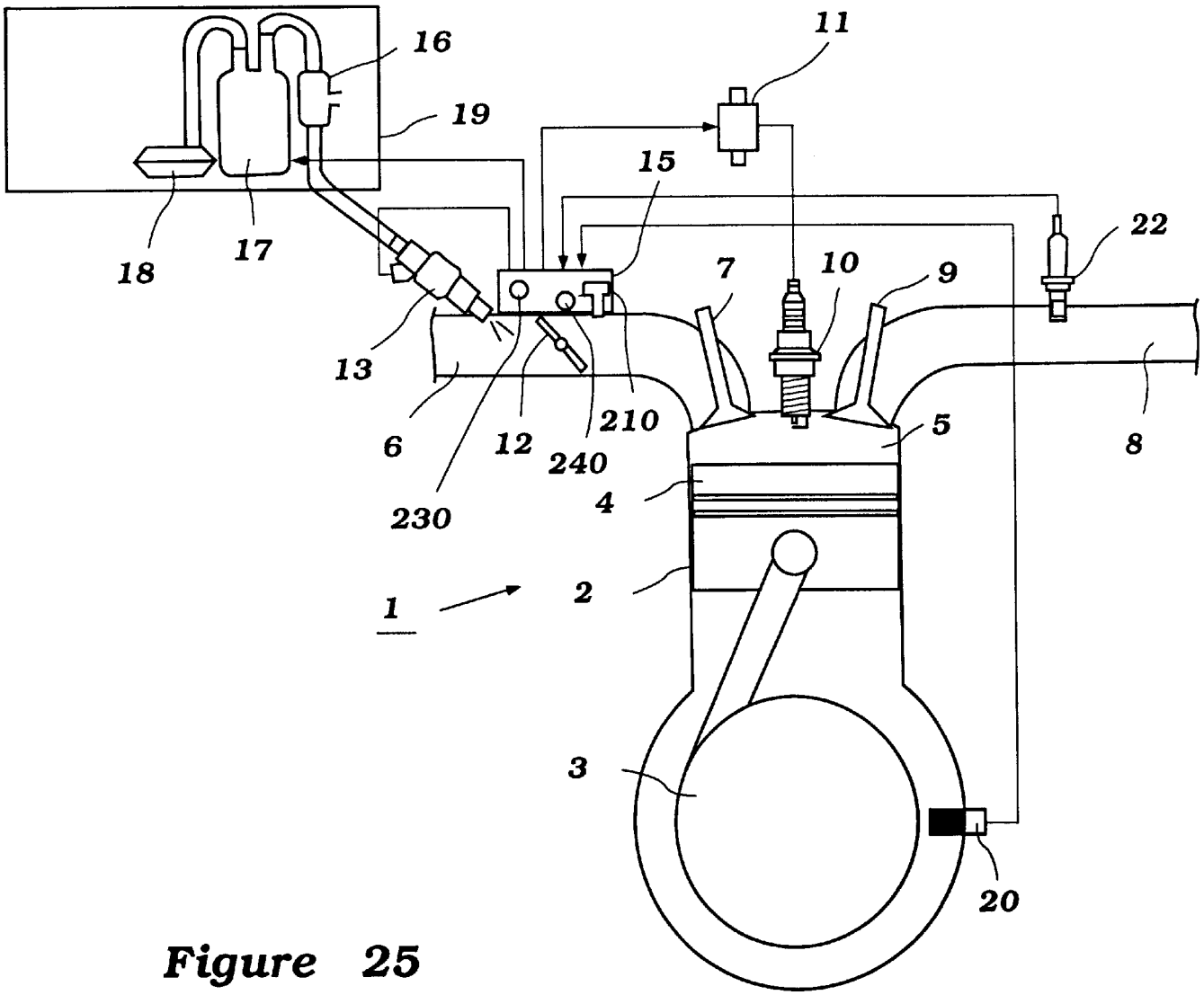
FIG. 25 is a schematic view illustrating the structure of an engine including a fourth embodiment of the injection control system according to the present invention.
Figure 26:
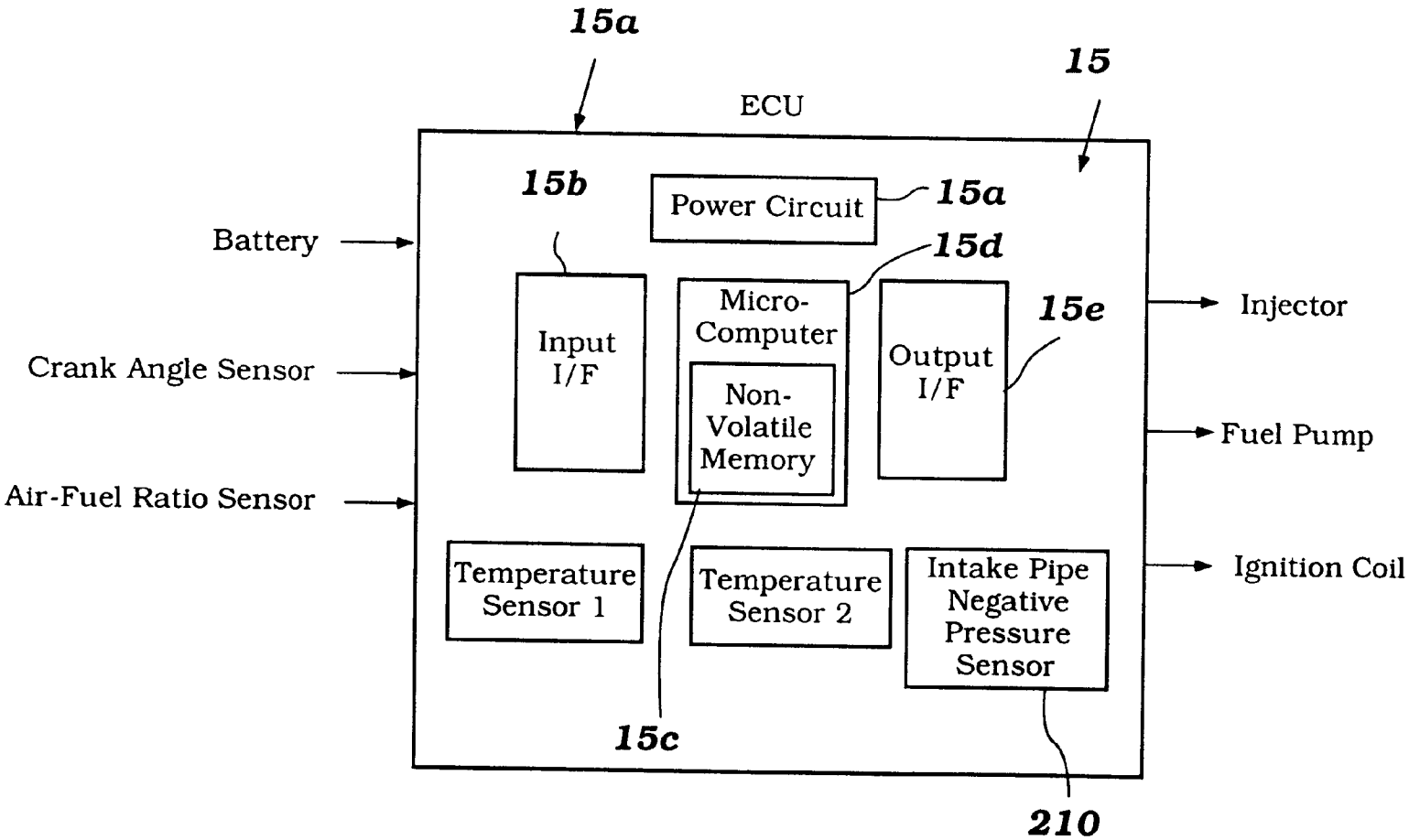
FIG. 26 is a schematic view illustrating the structure of the controller 15 indicated in FIG. 25.

FIGS. 24–34 indicate a fourth embodiment of the fuel injection control system according to the present invention. In the figures, the elements which are the same as those in FIGS. 1–12 have the same numerals, and explanation will be omitted. FIG. 25 is a schematic view illustrating the structure of an engine, and FIG. 26 is a schematic view illustrating the structure of the controller 15 indicated in FIG. 25. In this embodiment, the throttle angle detector 23 indicated in FIG. 2 is omitted. Instead, the controller 25 includes an intake pipe pressure sensor 21 (intake pressure detector) for detecting the intake pressure in the intake pipe 6, a temperature sensor 230 (temperature sensor 1) for detecting the temperature disposed slightly apart from the intake pipe 6, and an intake pipe wall temperature detector 24 (temperature sensor 2) for detecting the wall temperature of the intake pipe 6.

Figure 27:
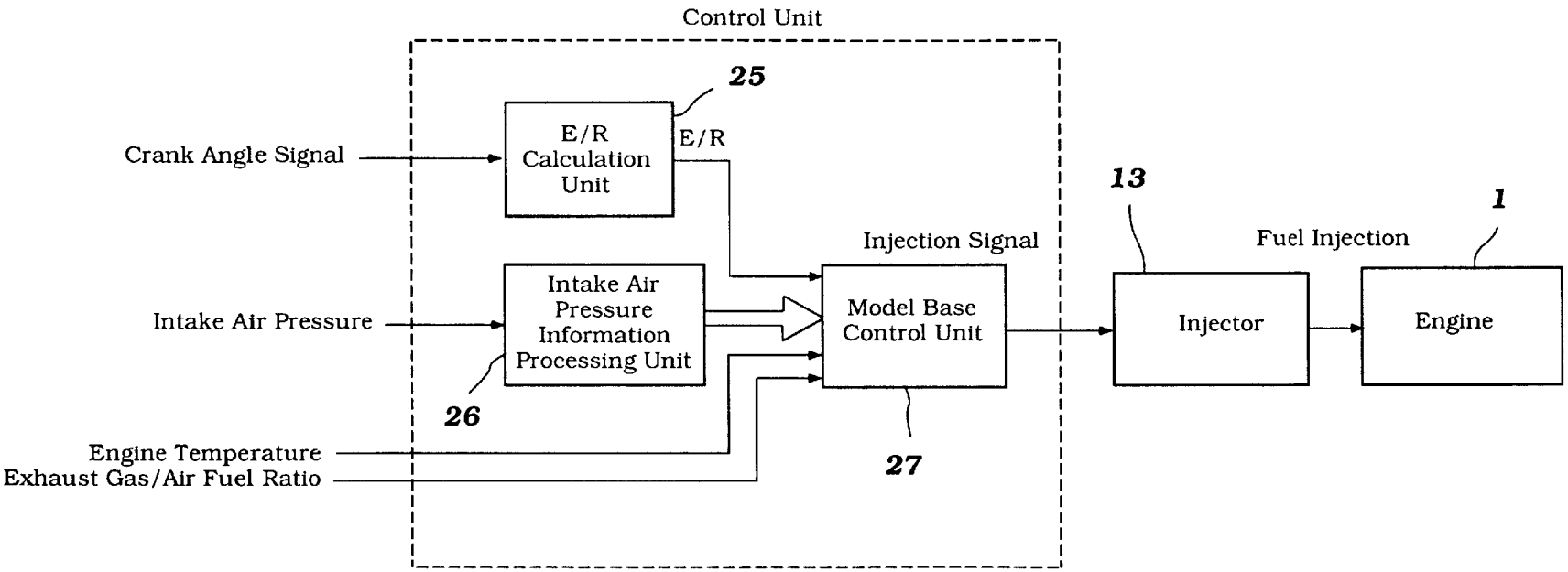
FIG. 27 is a schematic block diagram of a control unit regulating the injector, which control is processed in the microcomputer 15*d* of FIG. 26.

FIG. 27 is a schematic block diagram of a control unit regulating the injector, which control is processed in the microcomputer 15*d* of FIG. 26. In this embodiment, similar to that indicated in FIG. 4, the model-based control unit 27 processes signals of engine revolutions, the engine temperature (presumed), and the air-fuel ratio, as well as plural data generated by an intake pressure information processing unit 260, instead of a signal of the throttle angle in FIG. 4. The model-based control unit outputs an injection signal to the injector 13.

Intake Pressure Information Processing Unit

Figure 28:
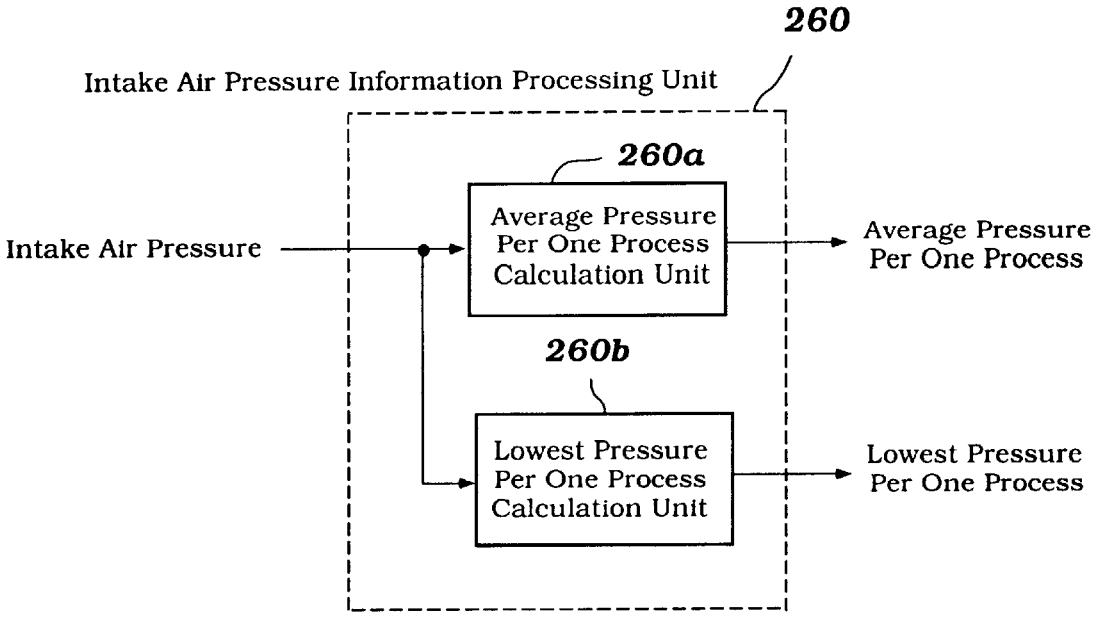
FIG. 28 is a schematic block diagram illustrating the structure of the intake pressure information processing unit 260 indicated in FIG. 27.

FIG. 28 is a schematic block diagram illustrating the structure of the intake pressure information processing unit 260 indicated in FIG. 27. The intake pressure information processing unit 260 comprises an average pressure calculation unit 260*a* for calculating the average intake pressure in one stroke after receipt of an intake gas signal, and a minimum pressure calculation unit 260*b* for calculating the minimum intake pressure in one stroke. The intake pressure information processing unit 260 outputs both signals to the model-based control unit 27*a*.

Model-Based Control Unit

Figure 29:
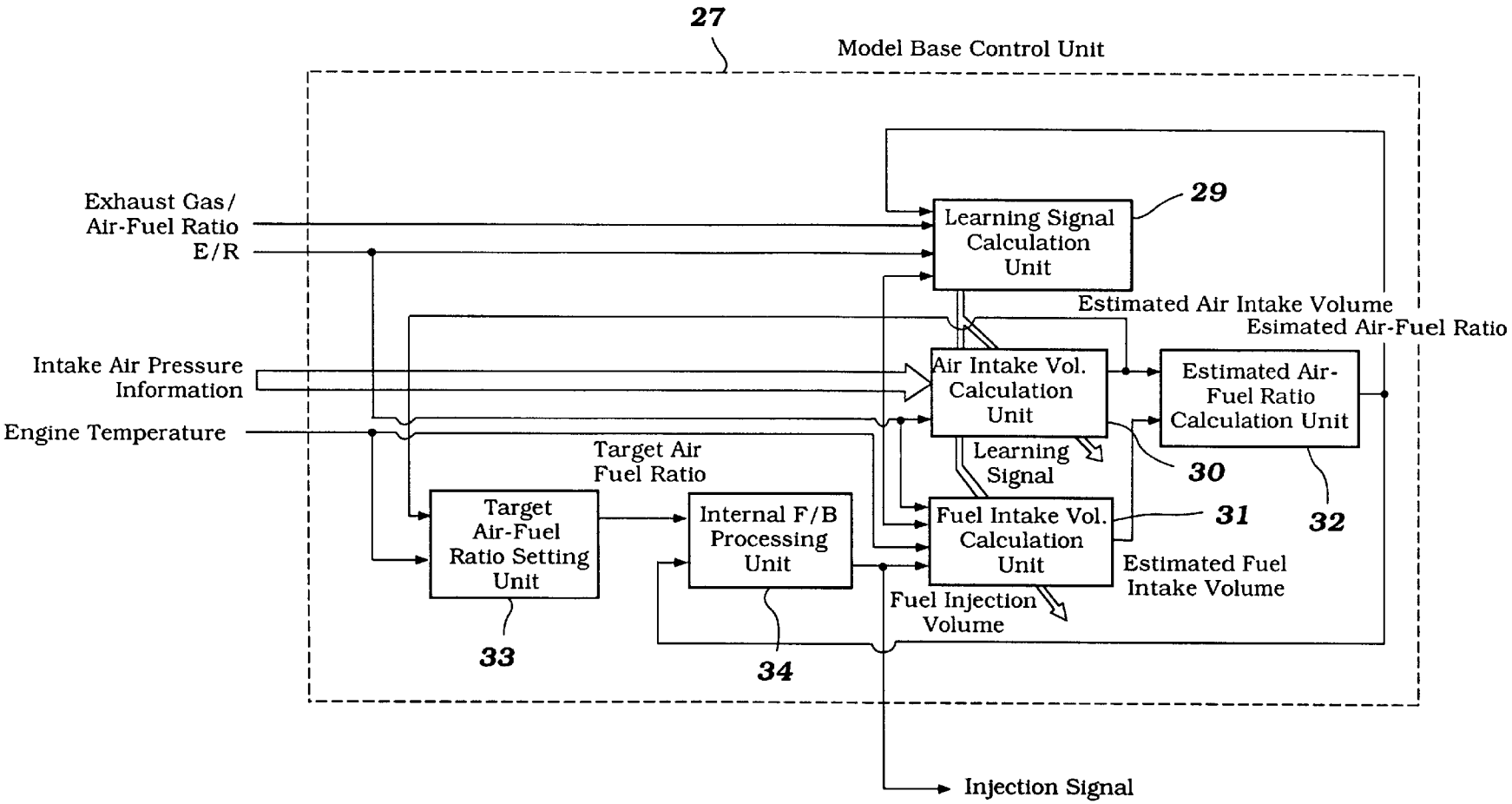
FIG. 29 is a schematic block diagram showing the structure of the model-based control unit 27 of FIG. 27.

FIG. 29 is a schematic block diagram showing the structure of the model-based control unit 27 of FIG. 27. The difference from the structure indicated in FIG. 5 is the use of intake pressure information instead of throttle angle information. The intake pressure information is inputted into the intake air quantity calculation unit 30 to determine the estimated intake air quantity. The other parts of the model-based control unit are the same as those indicated in FIGS. 4, 5A, 5B, and 6.

Figure 30:
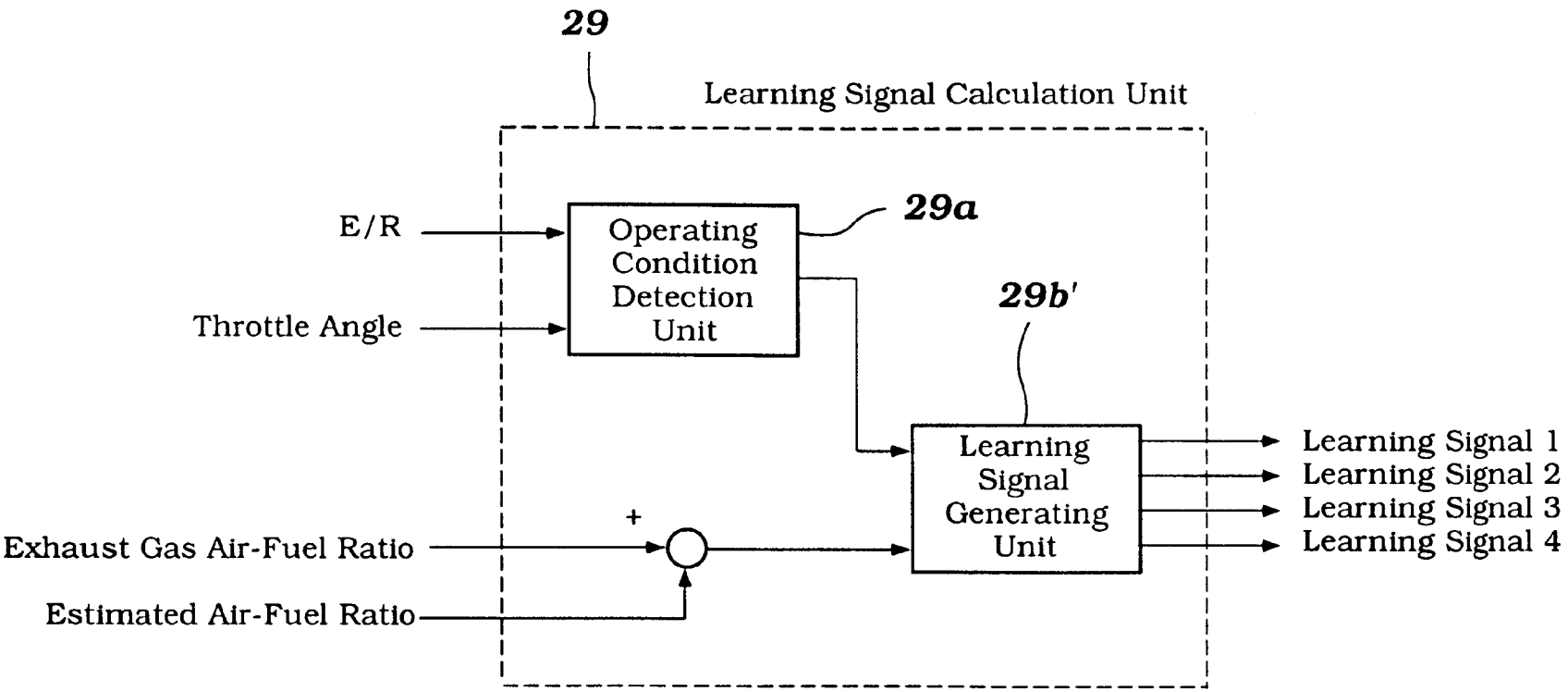
FIG. 30 is a schematic block diagram illustrating the structure of the learning signal calculation unit 29 indicated in FIG. 29.

FIG. 30 is a schematic block diagram illustrating the structure of the learning signal calculation unit 29 indicated in FIG. 29. The difference from the structure indicated in FIG. 8 is the use of the estimated intake air quantity, instead of the throttle angle, which is inputted into the driving condition detector 29*a*. The other parts of the learning signal calculation unit 29 are the same as those in FIG. 8.

Fuzzy Neural Network Used in Intake Air quantity Calculation Unit

Figure 31:
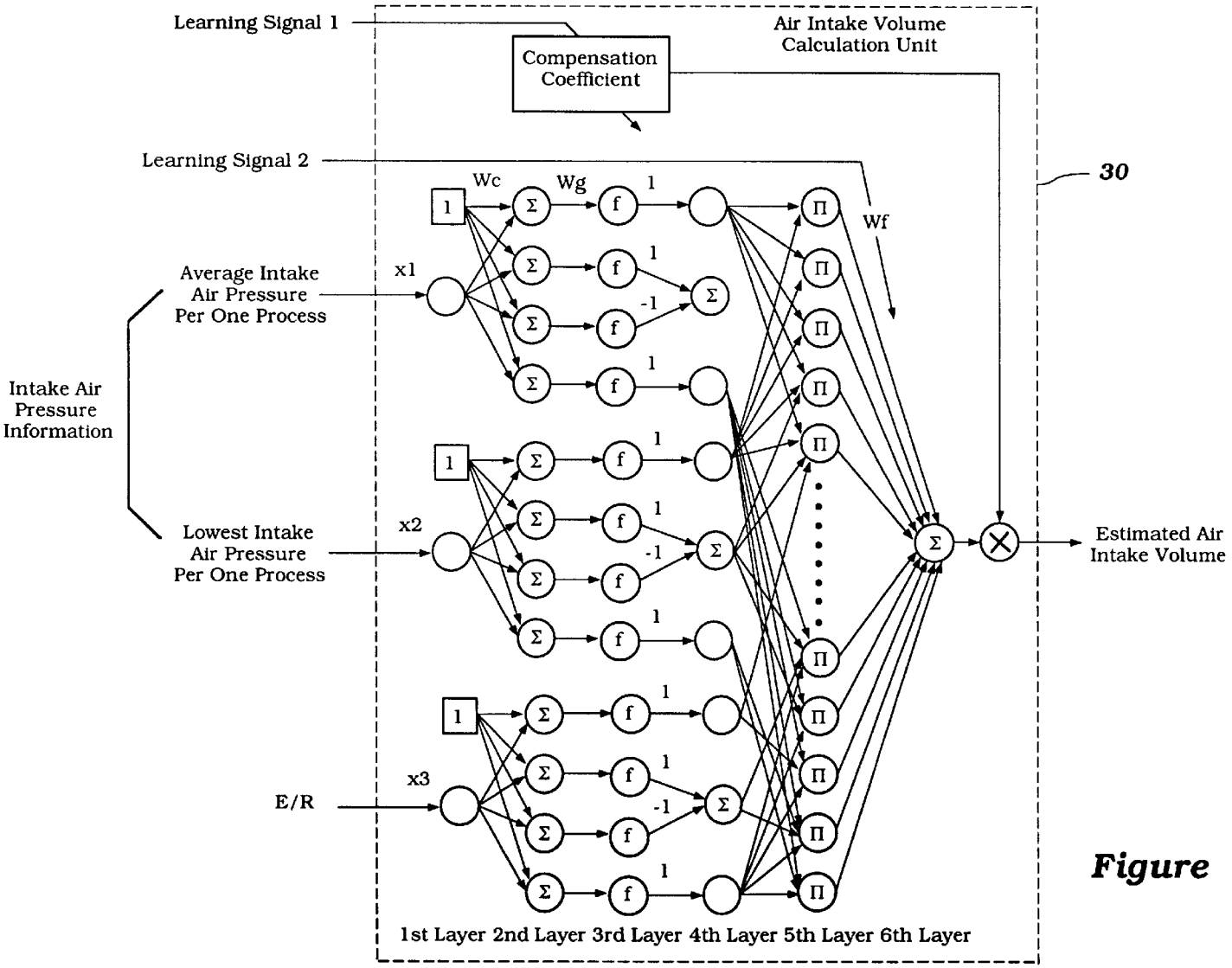
FIG. 31 is a schematic view illustrating a fuzzy neural network for determining the estimated intake air quantity at the intake air quantity calculation unit 30 indicated in FIG. 29.

FIG. 31 is a schematic view illustrating a fuzzy neural network for determining the estimated intake air quantity at the intake air quantity calculation unit 30 indicated in FIG. 29. The estimated intake air quantity cannot be determined based on equations, and thus is modeled using the fuzzy neural network. The fuzzy neural network comprises a hierarchical fuzzy neural network composed of six layers, as described with reference to FIG. 10. In this embodiment, in the preceding portion, the average intake pressure for one stroke and the minimum intake pressure for one stroke are inputted, in addition to engine revolutions. Further, a compensation coefficient is modified based on learning signal 1 used as teacher data, thereby modifying the estimated intake air quantity to compensate for the discrepancy of the A/F due to the changes in environmental conditions (a change in air density).

Figure 32:
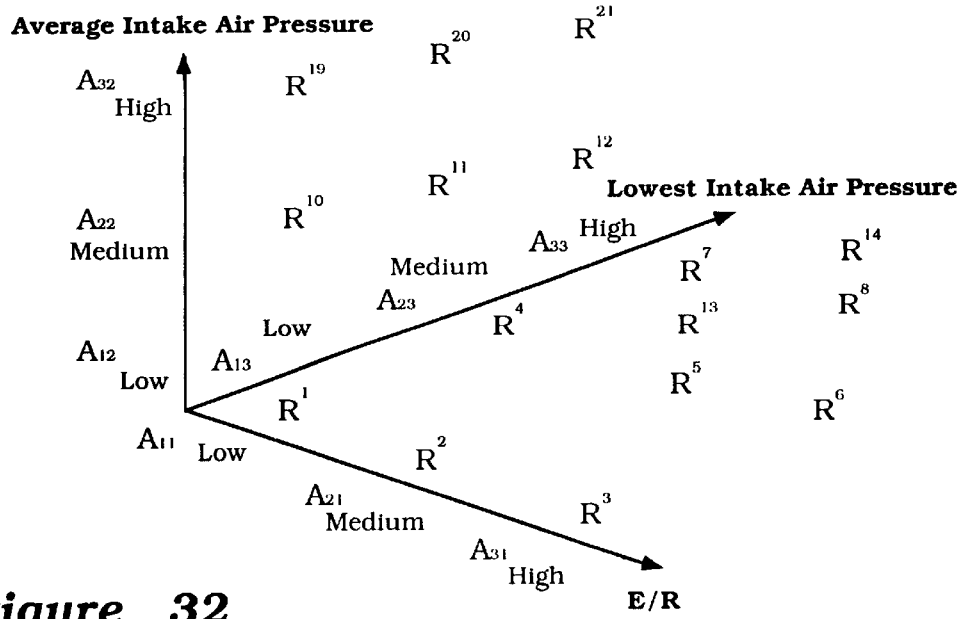
FIG. 32 is a schematic diagram showing the rules in the form of a three-dimensional map.
Figure 33A:
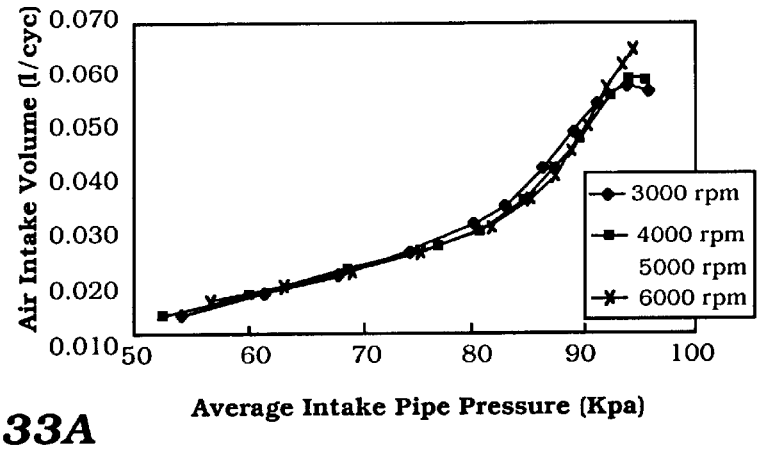
FIGS. 33A and 33B are graphs showing high correlation between the intake air quantity and the average intake pressure for one stroke (FIG. 33A), and between the intake air quantity and the minimum intake pressure signal for one stroke (FIG. 33B).
Figure 33B:
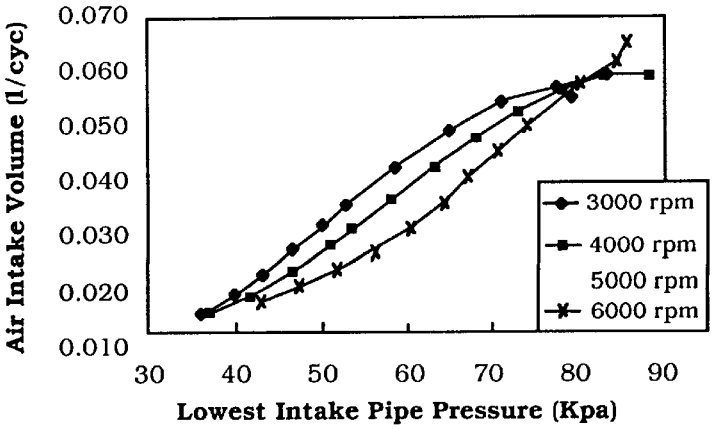

In this embodiment, the rule comprises: three conditions for each input information, A11, A21, and A31 for engine revolutions, A12, A22, and A32 for the average intake pressure, and A13, A23, and A33 for the minimum intake pressure; and nine results R1–R9 corresponding to the conditions. FIG. 32 is a schematic diagram showing the rules in the form of a three-dimensional map. The vertical axis shows conditions A12, A22, and A32 for the average intake pressure, and the two horizontal axes show conditions A11, A21, and A31 for engine revolutions, and conditions A13, A23, and A33 for the minimum intake pressure. The 27 segments defined by the respective conditions show results R1–R27.

In the above, conditions A11, A21, and A31 denote that engine revolutions is in a "low range", "intermediate range", and "high range", respectively. Conditions A12, A22, and A32 denote that the average intake pressure for one stroke is "low", "intermediate", and "high", respectively. Conditions A13, A23, and A33 denote that the minimum intake pressure for one stroke is "low", "intermediate", and "high", respectively. Results R1–R27 denote the estimated intake air quantity corresponding to the engine revolutions, the average intake pressures for one stroke, and the minimum intake pressure for one stroke. According to the above rules and conditions, 27 principles can be created, e.g., "when engine revolutions is in an intermediate range, the average intake pressure is intermediate, and the minimum intake pressure is intermediate, the estimated intake air quantity is V1", and "when engine revolutions is in a high range, the average intake pressure is high, and the minimum intake pressure is high, the estimated intake air quantity is V2."

The layers from the first layer through the fourth layer, constituting the preceding portion, are divided into two processing processes, one for engine revolutions, and the other for the average intake pressure for one stroke and the minimum intake pressure for one stroke. At the first layer, each signal of engine revolutions, the average intake pressure for one stroke, and the minimum intake pressure for one stroke is inputted as input signal xi (i=1, 2, or 3), and at the second layer through the fourth layer, contribution aij of each input signal xi is determined for each of conditions A11, A21, A31, A12, A22, A32, A13, A23, and A33. That is, contribution aij can be calculated using a sigmoid equation f(xi) indicated below as equation (4) described earlier.

Based on the sigmoid equation, after contribution aij of each input signal xi (engine revolutions signal, the average intake pressure signal for one stroke and the minimum intake pressure signal for one stroke) is determined for each of conditions A11, A21, A31, A12, A22, A32, A13, A23, and A33 at the fourth layer, conformity $\mu i$ is determined at the fifth layer, based on contribution aij, for each of 27 results R1–R27 regarding the inputted engine revolutions signal and the average intake pressure signal for one stroke, and the minimum intake pressure signal for one stroke, using equation (5). Further, conformity $\mu i$ (i=1–27) is normalized to obtain a normalized conformity using equation (6). At the sixth layer, the estimated intake air quantity V is determined by using a weighted mean of the normalized conformity for each result obtained by equation (6) and each output fi of fuzzy rules (i.e., output corresponding to each of results R1–R27), using equation (8).

$$\text{Estimated intake air flow } V = \sum_i \mu' i f i \tag{8}$$

In the above, the intake air quantity calculation unit 30 has a learning function. Using the learning function, in the beginning, the unit undergoes the learning of the fuzzy neural network by correcting coupling coefficient Wf in such a way that the difference between the experimentally obtained intake air quantity and the intake air quantity outputted from the fuzzy neural network is minimized. Thereafter, by undergoing learning by the fuzzy neural network, coupling coefficient Wf is updated in such a way as to minimize the value of learning signal 2, i.e., the A/F discrepancy.

FIGS. 32A and 32B are graphs showing high correlation between the intake air quantity and the average intake pressure for one stroke (FIG. 33A), and between the intake air quantity and the minimum intake pressure signal for one stroke (FIG. 33B) in a wide range of engine revolutions. Intake pressure information highly correlated with the intake air quantity is not limited to the above, and may include information about a difference between the highest pressure and the lowest pressure or pulsated frequencies of the intake pressure. Further, more than two types of information can be used. Further, the fuzzy neural network indicated in FIG. 31 for determining the estimated intake air quantity is simply an example and can include more than 27 results by further dividing the driving conditions.

Intake Fuel Calculation Unit

Figure 34:
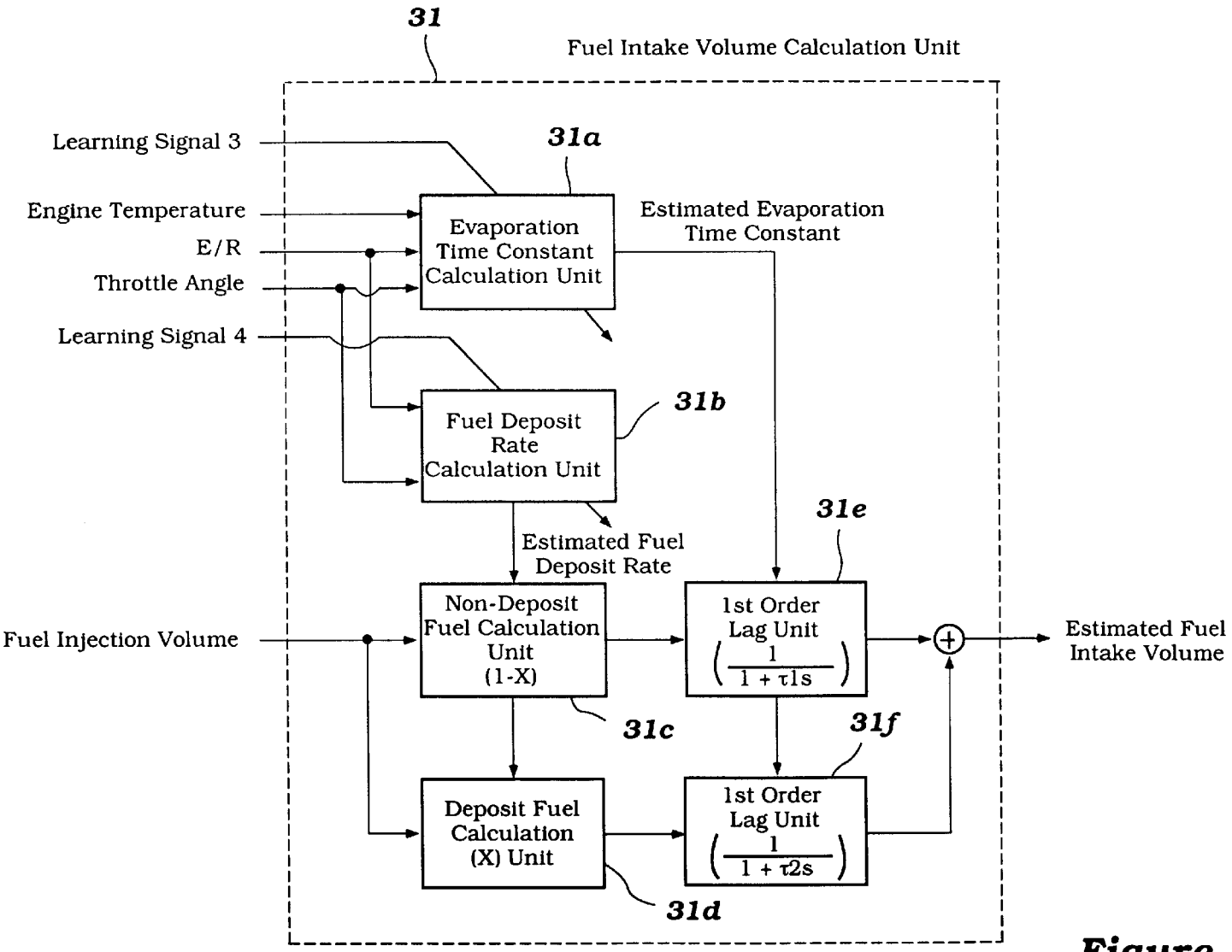
FIG. 34 is a schematic block diagram illustrating the learning model of the intake fuel quantity calculation unit 31 indicated in FIG. 29.

FIG. 34 is a schematic block diagram illustrating the learning model of the intake fuel quantity calculation unit 31 indicated in FIG. 29. The difference from the structure indicated in FIG. 12 is the use of the estimated intake air quantity instead of the throttle angle as the signal inputted into the evaporation time constant calculation unit 31*a* and the fuel deposition rate calculation unit 31*b*. The other parts of the intake fuel quantity calculation unit are the same as those indicated in FIG. 12.

Figure 35:
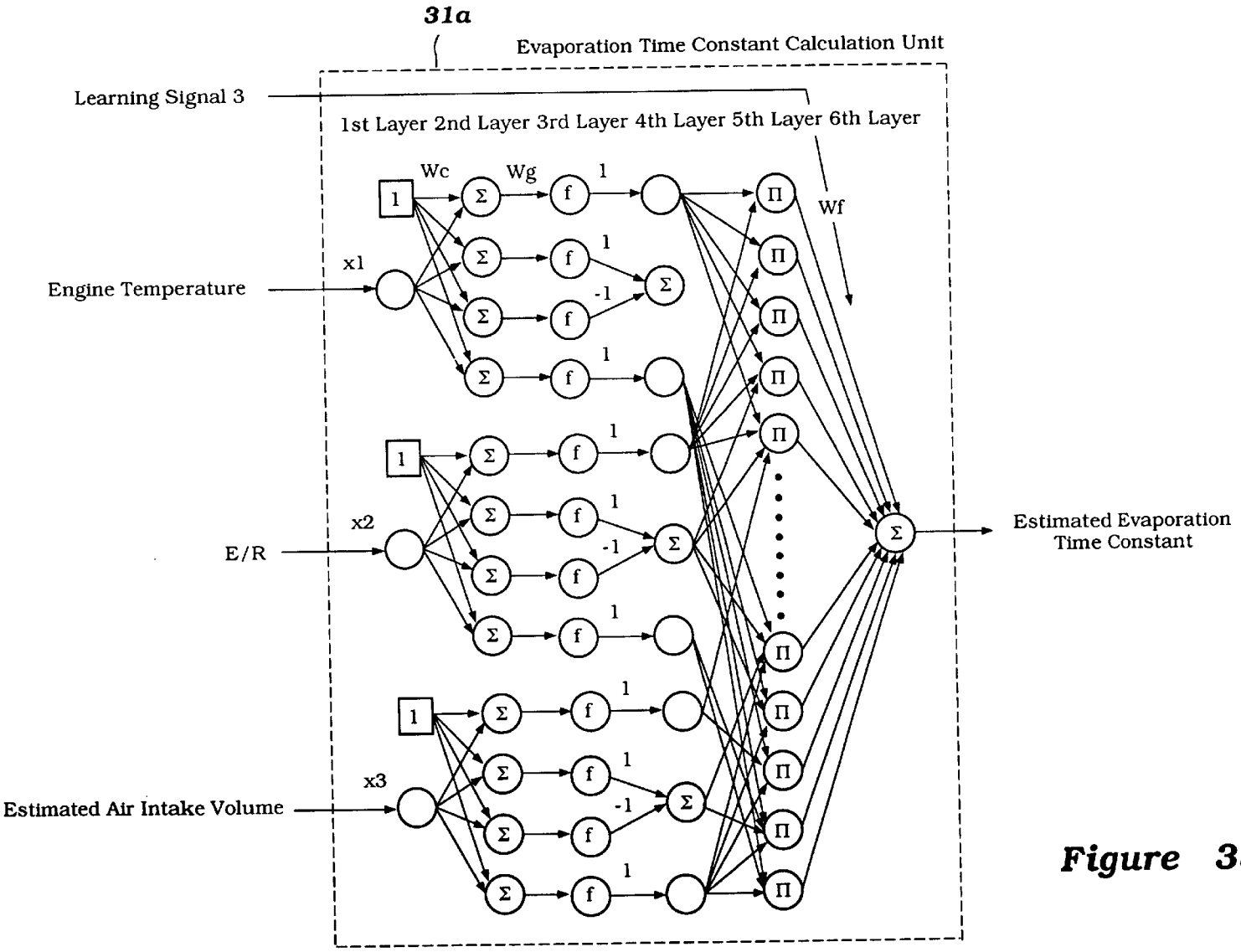
FIG. 35 is a schematic view illustrating a fuzzy neural network for estimating an evaporation time constant at the evaporation time constant calculation unit 31*a* indicated in FIG. 29.

FIG. 35 is a schematic view illustrating a fuzzy neural network for estimating an evaporation time constant at the evaporation time constant calculation unit 31*a* indicated in FIG. 29. The basic structure and principle of this fuzzy neural network are the same as those illustrated with reference to FIG. 13. The difference from FIG. 13 is the use of the estimated intake air quantity instead of the throttle angle.

In the fourth embodiment, the same effects as in the first embodiment can be exhibited although the control structures are relatively simpler than those in the first embodiment.

Fifth Embodiment

Figure 36:
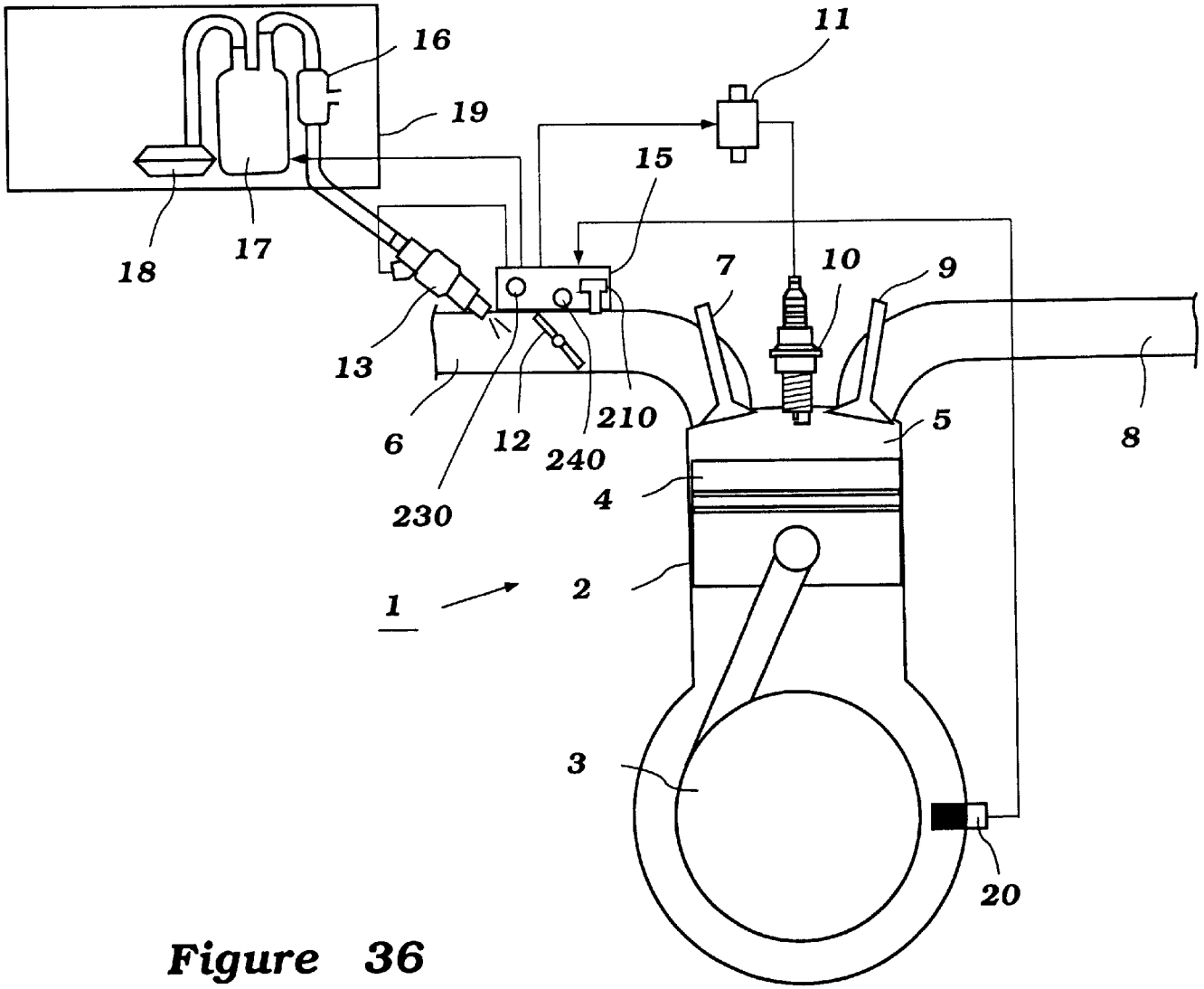
FIG. 36 is a schematic view illustrating the structure of an engine including a sixth embodiment of the injection control system according to the present invention.
Figure 37:
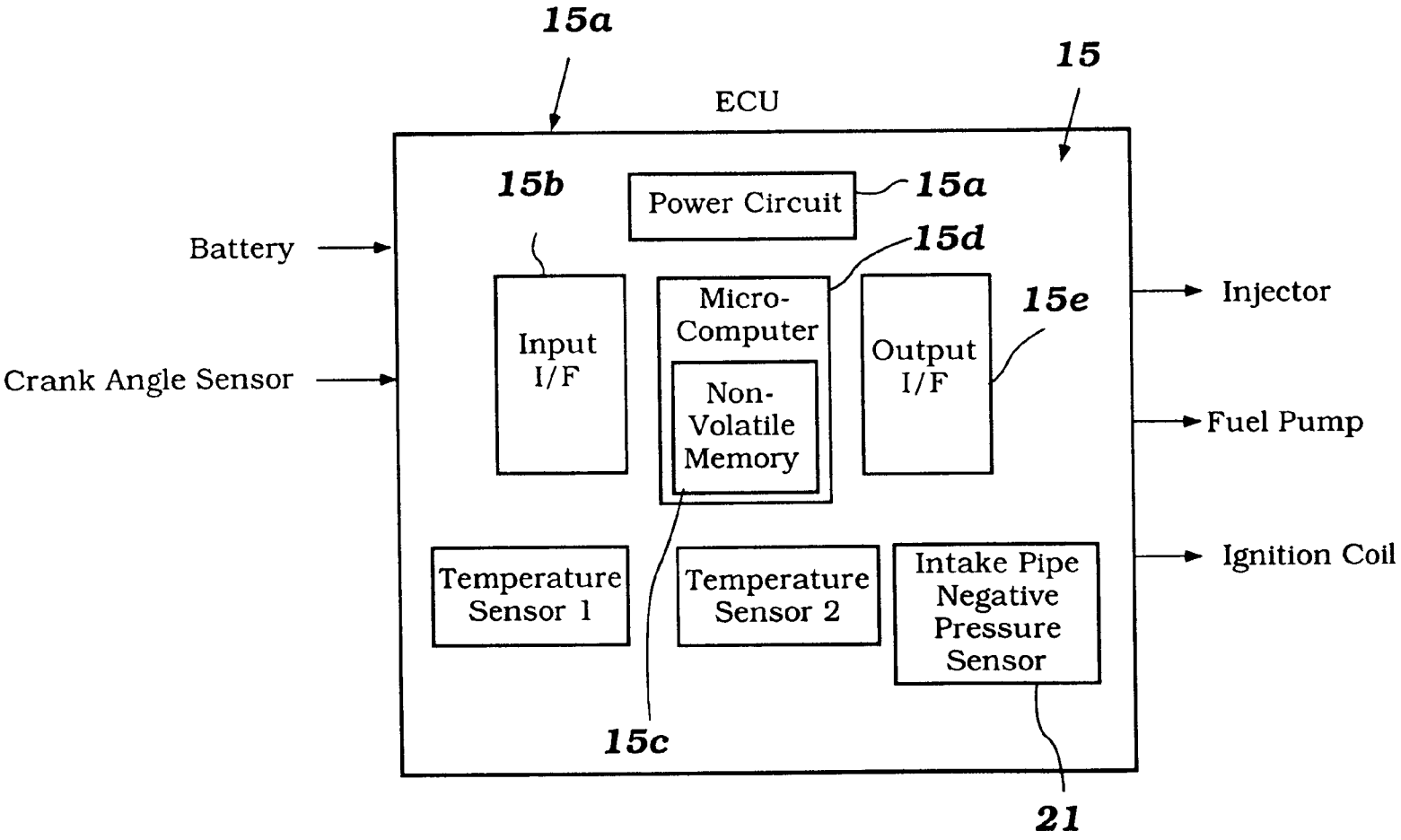
FIG. 37 is a schematic view illustrating the structure of the controller 15 indicated in FIG. 36.

FIGS. 35–39 illustrate a fifth embodiment of the fuel injection control device according to the present invention. In the figures, the elements which are the same as those in FIGS. 24–34 have the same numerals, and explanation will be omitted. FIG. 36 is a schematic view illustrating the structure of an engine, and FIG. 37 is a schematic view illustrating the structure of the controller 15 indicated in FIG. 36. In this embodiment, the air-fuel sensor 22 indicated in FIG. 25 is omitted, thereby further simplifying the structures. This embodiment is based on the same principle as in the fourth embodiment and is analogous to the third embodiment in relation to the first embodiment, with respect to the mechanism represented by FIG. 18 described above.

Figure 38:
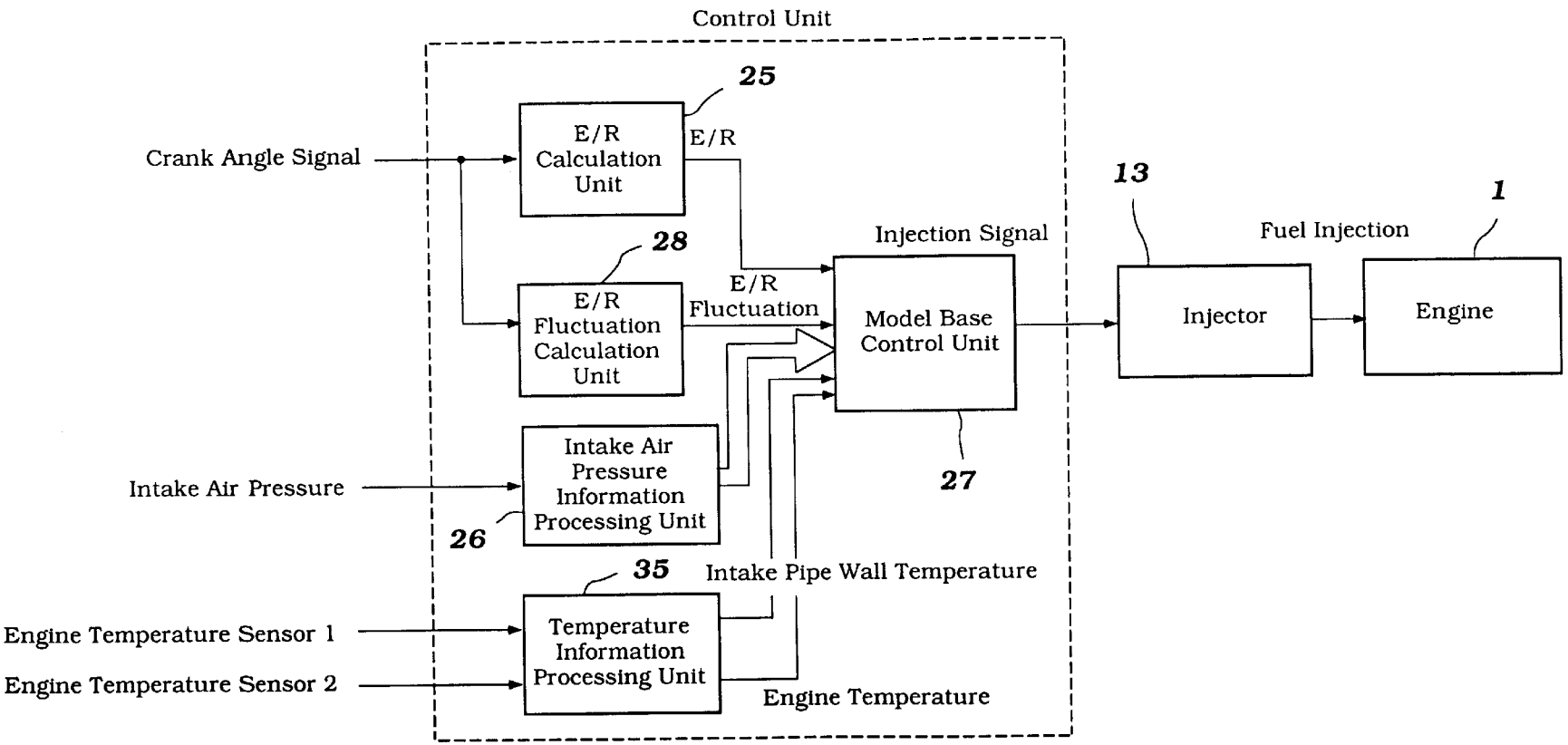
FIG. 38 is a schematic block diagram of a control unit regulating the injector, which control is processed in the microcomputer 15*d* of FIG. 37.

FIG. 38 is a schematic block diagram of a control unit regulating the injector, which control is processed in the microcomputer 15*d* of FIG. 37. In this embodiment, as compared with that indicated in FIG. 27, the revolution fluctuation calculation unit 28 indicated in FIG. 20 is provided for calculating the revolution fluctuation of the crank shaft 3 based on the crank angle signal, and output of the revolution fluctuation calculation unit 28, instead of the air-fuel ratio in the exhaust, is inputted into the model-based controller 27. Further, signals from the temperature sensors 1 and 2 are inputted into a temperature information processing unit 350 which outputs temperatures of the engine and the intake pipe wall to the model-based controller 27.

Figure 39A:
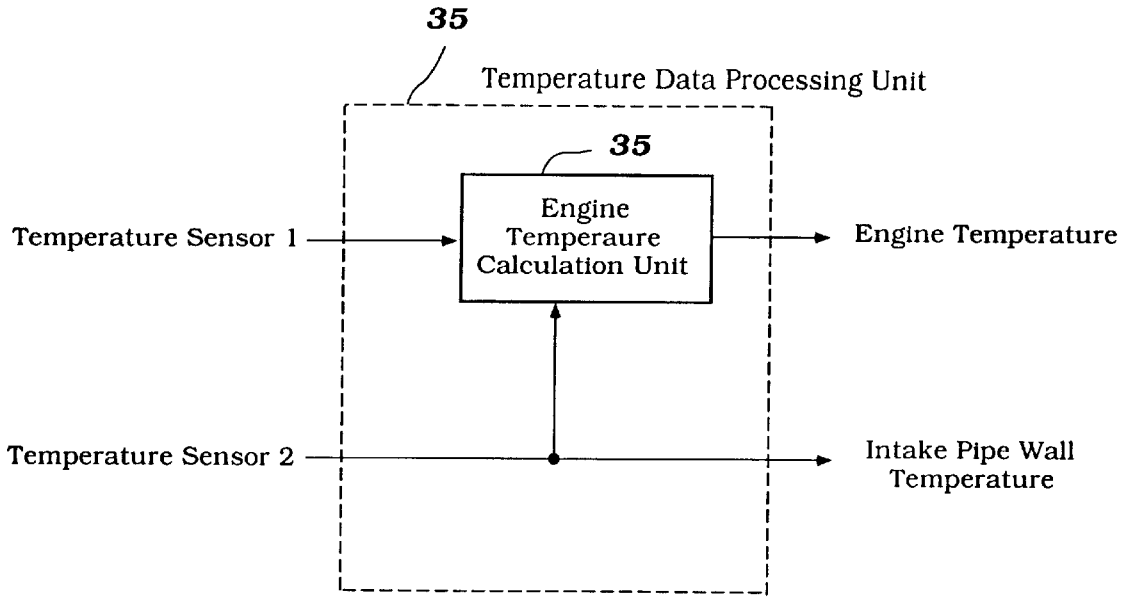
FIG. 39A is a schematic block diagram illustrating the structure of the temperature information processing unit 35 indicated in FIG. 38.
Figure 39B:
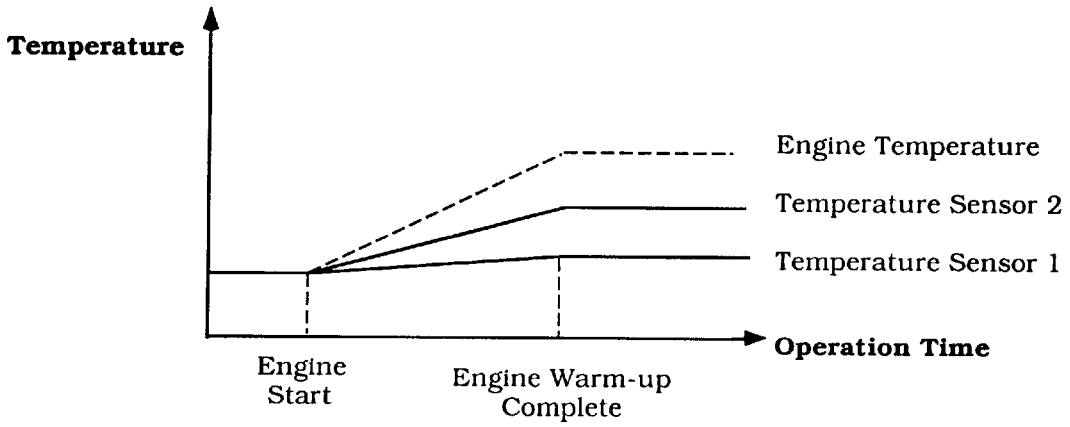
FIG. 39B is a graph indicating changes in engine temperature with elapsed time.

FIG. 39A is a schematic block diagram illustrating the structure of the temperature information processing unit 35 indicated in FIG. 38. FIG. 39B is a graph indicating changes in engine temperature with elapsed time. Using the signals from the temperature sensors 1 and 2, the engine temperature is calculated at an engine temperature calculation unit 350*a*, and outputted to the model-based controller 27. The engine temperature can be calculated and estimated from the temperature of the intake pipe wall detected by the temperature sensor 2, and the temperature detected by temperature sensor 1 disposed slightly apart from the intake pipe, as shown in FIG. 39B. The signal from the temperature sensor 2 is outputted directly to the model-based controller 27.

Model-Based Control Unit

Figure 40:
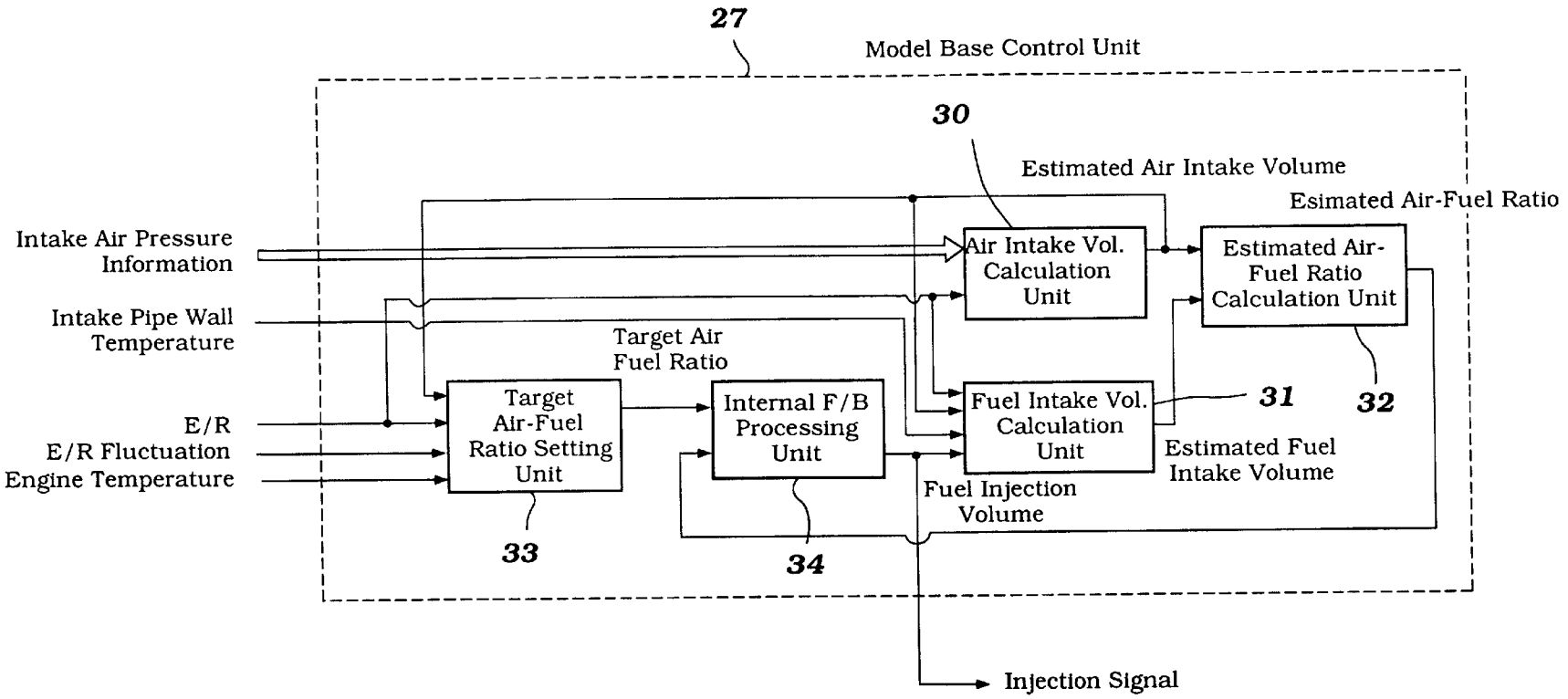
FIG. 40 is a schematic block diagram showing the structure of the model-based control unit 27 of FIG. 38.

FIG. 40 is a schematic block diagram showing the structure of the model-based control unit 27 of FIG. 38. In this embodiment, the learning signal calculation unit 29 indicated in FIG. 29 is omitted. Accordingly, the intake air quantity calculation unit 30 and the intake fuel quantity calculation unit 31 do not receive a learning signal, and the intake fuel quantity calculation unit 31 receives a signal of the intake pipe wall temperature, instead of a signal of the engine temperature. The estimated air-fuel ratio calculation unit 32 and the internal feedback processing unit 34 are the same as those in FIG. 29. The target air-fuel ratio calculation unit 33 receives the temperature of the engine, the estimated intake air quantity, and engine revolutions, and further receives a signal of the aforesaid revolution fluctuation as teacher data. That is, the target air-fuel ratio is changeably set in accordance with the revolution fluctuation of the engine.

The target air-fuel ratio setting unit 33 is the same as that illustrated in FIG. 22. The fuzzy neural network for estimating a target air-fuel ratio at the target air-fuel ratio learning unit 33*d* is also the same as that indicated in FIG. 23. Further, the flow of learning the target air-fuel ratio is the same as that indicated in FIG. 24. Thus, explanation will be omitted.

In addition, the temperature information processing unit 350 can be adapted to the embodiment shown in FIG. 27, and in that case, the intake pipe wall temperature, instead of the engine temperature, is inputted into the intake fuel quantity calculation unit 31 indicated in FIG. 29.

Sixth Embodiment

Figure 41:
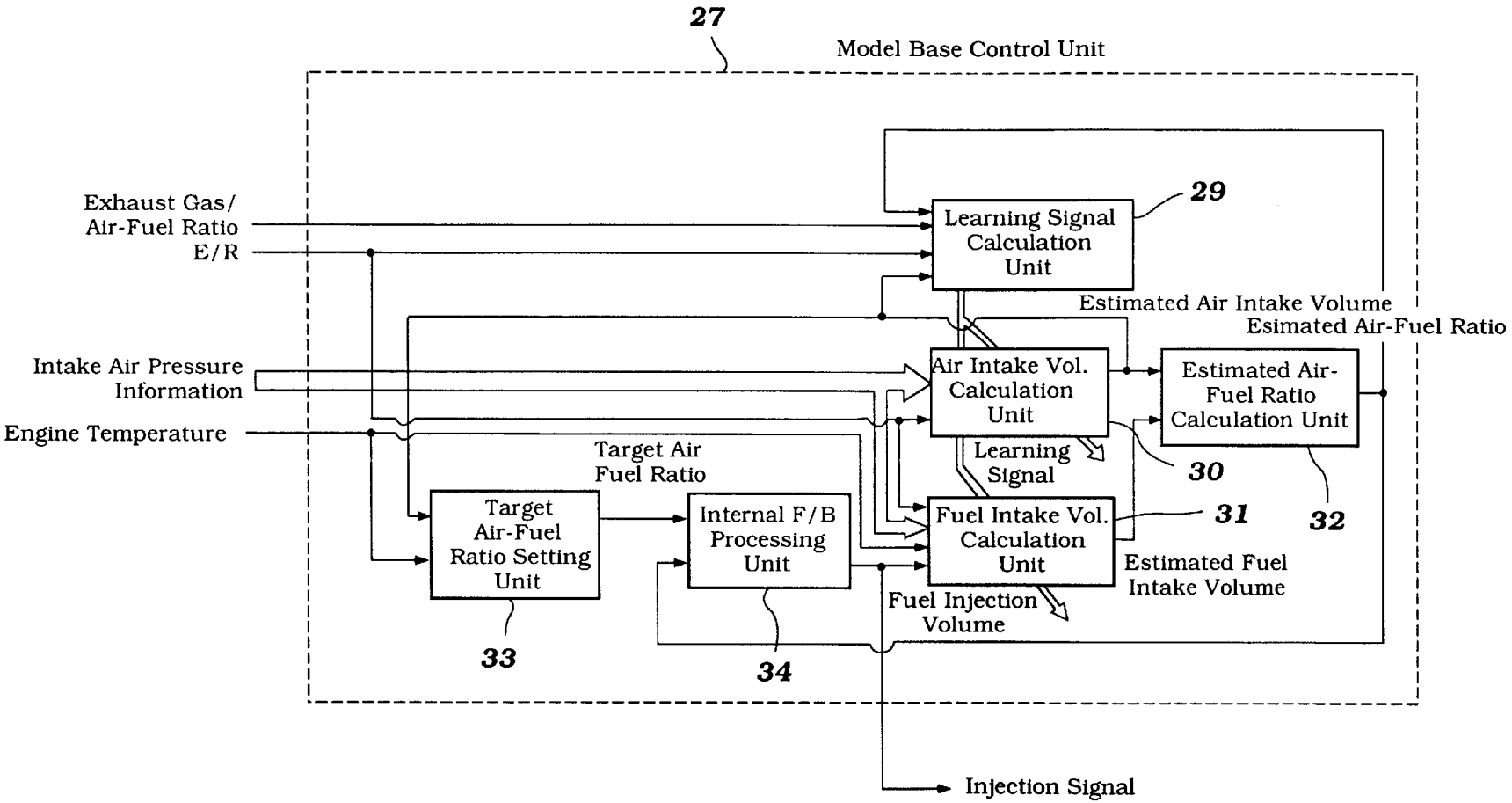
FIG. 41 is a schematic block diagram illustrating a sixth embodiment of the model-based controller 27.

FIG. 41 is a schematic block diagram illustrating a sixth embodiment of the model-based controller 27. In the fourth embodiment, the intake fuel quantity calculation unit 31 receives the estimated intake air quantity, but in this embodiment, the intake fuel quantity calculation unit 31 receives plural pieces of the intake pressure information, instead of the estimated intake air quantity. In the same way as above, plural pieces of the intake pressure information can be used instead of the estimated intake air quantity in FIGS. 33 and 39.

Seventh Embodiment

Figure 42:
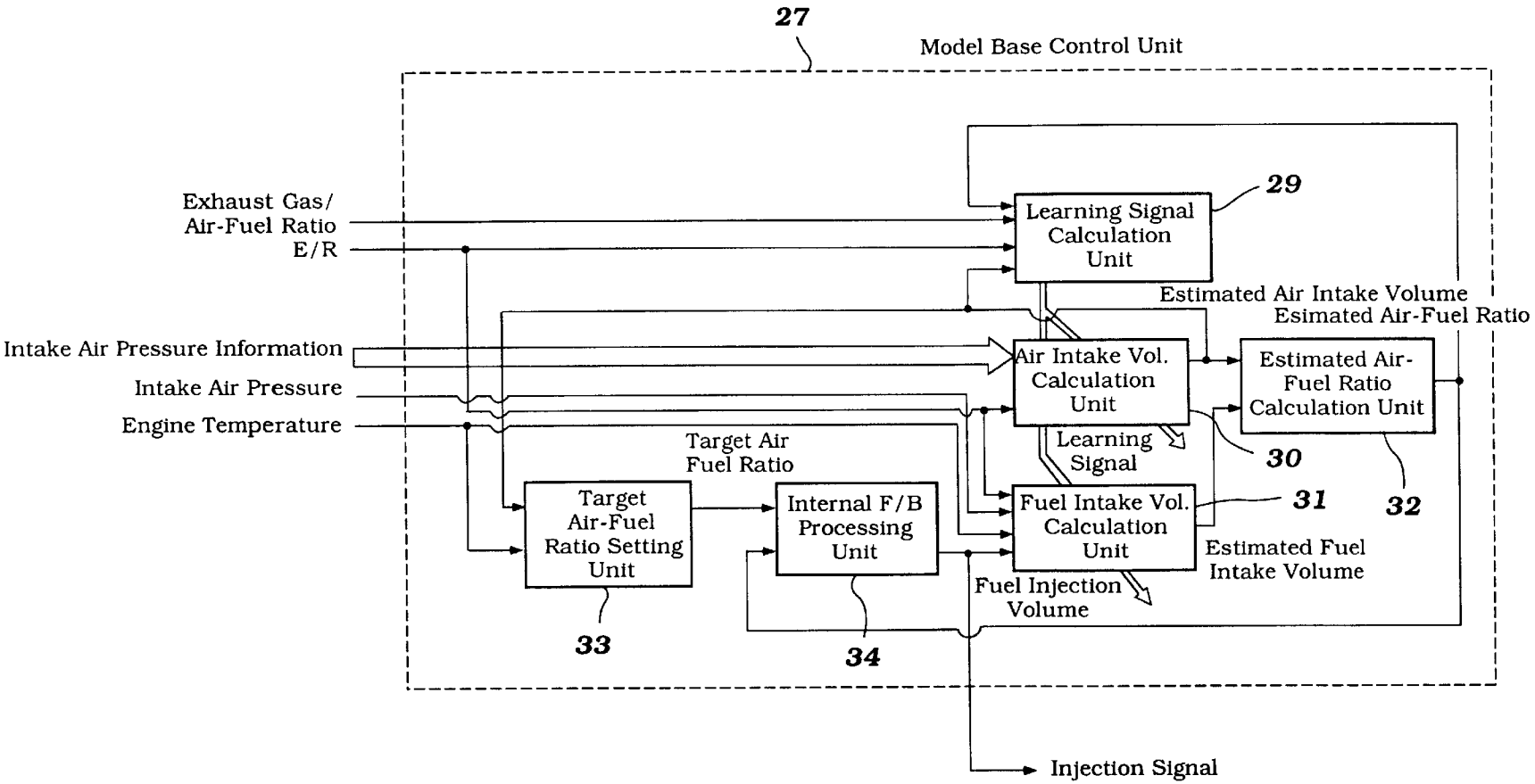
FIG. 42 is a schematic block diagram illustrating a seventh embodiment of the model-based controller 27.

FIG. 42 is a schematic block diagram illustrating a seventh embodiment of the model-based controller 27. In the sixth embodiment, the intake fuel quantity calculation unit 31 receives plural pieces of the intake pressure information, but in this embodiment, the intake fuel quantity calculation unit 31 receives the measured intake pressure, instead of the plural pieces of the intake pressure information. In the same way as above, the measured intake pressure can be used instead of plural pieces of the intake pressure information in FIGS. 33 and 39.

Other Features

Although the control systems capable of learning in the model-based controller are fuzzy neural networks in the aforesaid embodiments, the systems need not be limited thereto, and other calculation models such as neural networks and CMAC (Cerebellar Model Arithmetic Computer), for example, can be used as long as the control systems are capable of learning. Further, in the above embodiments, the present invention is adapted to the four-cycle engine, but need not be limited thereto. For example, the present invention can be adapted to a two-cycle engine wherein the air-fuel sensor can be installed in such a way as to directly detect the air-fuel ratio in a combustion gas inside the cylinder.

Although this invention has been described in terms of a certain embodiment, other embodiments apparent to those of ordinary skill in the art also are within the scope of this invention. Accordingly, the scope of the invention is intended to be defined only by the claims that follow.

Of course, the foregoing description is that of preferred embodiments of the invention, and various changes and modifications may be made without departing from the spirit and scope of the invention, as defined by the appended claims.

What is claimed is:

1. A fuel injection control system of an engine which is operable by a signal of fuel injection quantity on an intake side of the engine, and the performance of which is indicatable by a signal of the air-fuel ratio on an exhaust side of the engine, said control system comprising:

an intake air quantity estimation unit for estimating the quantity of intake air, which is programmed to output an estimated intake air quantity signal based on predetermined input signals of engine conditions;

an intake fuel quantity estimation unit for estimating the quantity of intake fuel, which is programmed to output an estimated intake fuel quantity signal based on predetermined input signals of engine conditions;

an estimated air-fuel ratio calculation unit for calculating an estimated air-fuel ratio, which is programmed to output an estimated air-fuel ratio signal when receiving the estimated intake air quantity signal and the estimated intake fuel quantity signal;

a target air-fuel ratio setting unit for setting a target air-fuel ratio, which is programmed to output a target air-fuel ratio signal based on predetermined input signals of engine conditions; and a feedback control unit for providing a fuel injection signal to the engine, which is programmed to provide a fuel injection signal for controlling fuel injection when receiving and comparing the estimated air-fuel ratio signal and the target air-fuel ratio signal, said fuel injection signal being outputted also to the intake fuel quantity estimation unit as one of the predetermined input signals;

wherein at least one unit selected from the intake air quantity estimation unit, the intake fuel estimation unit, and the target air-fuel ratio setting unit is provided with a learning function, said learning function being programmed to modify output from the at least one unit based on teacher data, wherein the teacher data used in the intake air quantity estimation unit and the intake fuel quantity estimation unit are a deviation of the actual air-fuel ratio from the estimated air-fuel ratio under given engine conditions, and the teacher data used in the target air-fuel ratio setting unit are a factor correlated to the actual air-fuel ratio under given engine conditions.

2. A system according to claim 1, wherein the intake air quantity estimation unit and/or the intake fuel quantity estimation unit are/is provided with the learning functions, and an actual air-fuel ratio sensor is provided on the exhaust side of the engine and measures the actual air-fuel ratio to determine the teacher data.

3. A system according to claim 2, wherein the intake air quantity estimation unit receives the teacher data when the engine conditions are included in a normal driving state.

4. A system according to claim 2, wherein the intake fuel quantity estimation unit receives the teacher data when the engine conditions are included in a transition driving state.

5. A system according to claim 1, wherein the target air-fuel ratio setting unit is provided with the learning function, and the factor correlated to the actual air-fuel ratio is an engine revolution fluctuation.

6. A system according to claim 1, wherein the predetermined input signals for the intake air quantity estimation unit includes engine revolutions and throttle angle.

7. A system according to claim 1, wherein the predetermined input signals for the intake air quantity estimation unit includes engine revolutions and intake pressure.

8. A system according to claim 1, wherein the predetermined signals for the intake fuel quantity estimation unit are selected from the group consisting of signals of engine revolutions, throttle angle, intake pressure, engine temperature, and intake pipe wall temperature, and a signal of the estimated intake air quantity outputted from the intake air quantity estimation unit, in addition to the fuel injection signal outputted from the feedback control unit.

9. A system according to claim 1, wherein the predetermined signals for the target air-fuel ratio setting unit are selected from the group consisting of signals of engine temperature and engine revolutions, and a signal of the estimated intake air quantity outputted from the intake air quantity estimation unit.

10. A method for fuel injection control of an engine which is operable by a signal of fuel injection quantity on an intake side of the engine, and the performance of which is indicatable by a signal of the air-fuel ratio on an exhaust side of the engine, said method comprising the steps of:

estimating the quantity of intake air by an intake air quantity estimation unit which is programmed to output an estimated intake air quantity signal based on predetermined input signals of engine conditions;

estimating the quantity of intake fuel by an intake fuel quantity estimation unit which is programmed to output an estimated intake fuel quantity signal based on predetermined input signals of engine conditions;

calculating an estimated air-fuel ratio by an estimated air-fuel ratio calculation unit which is programmed to output an estimated air-fuel ratio signal when receiving the estimated intake air quantity signal and the estimated intake fuel quantity signal;

setting a target air-fuel ratio by a target air-fuel ratio setting unit which is programmed to output a target air-fuel ratio signal based on predetermined input signals of engine conditions; and providing a fuel injection signal to the engine by a feedback control which is programmed to provide a fuel injection signal for controlling fuel injection when receiving and comparing the estimated air-fuel ratio signal and the target air-fuel ratio signal, said fuel injection signal being outputted also to the intake fuel quantity estimation unit as one of the predetermined input signals;

wherein at least one unit selected from the intake air quantity estimation unit, the intake fuel estimation unit, and the target air-fuel ratio setting unit is provided with a learning function, said learning function being programmed to modify output from the at least one unit based on teacher data, wherein the teacher data used in the intake air quantity estimation unit and the intake fuel quantity estimation unit are a deviation of the actual air-fuel ratio from the estimated air-fuel ratio under given engine conditions, and the teacher data used in the target air-fuel ratio setting unit are a factor correlated to the actual air-fuel ratio under given engine conditions.

11. A method according to claim 10, wherein the intake air quantity estimation unit and/or the intake fuel quantity estimation unit are/is provided with the learning functions, and an actual air-fuel ratio sensor is provided on the exhaust side of the engine and measures the actual air-fuel ratio to determine the teacher data.

12. A method according to claim 11, wherein the intake air quantity estimation unit receives the teacher data when the engine conditions are included in a normal driving state.

13. A method according to claim 11, wherein the intake fuel quantity estimation unit receives the teacher data when the engine conditions are included in a transition driving state.

14. A method according to claim 10, wherein the target air-fuel ratio setting unit is provided with the learning function, and the factor correlated to the actual air-fuel ratio is an engine revolution fluctuation.

15. A method according to claim 10, wherein the predetermined input signals for the intake air quantity estimation unit includes engine revolutions and throttle angle.

16. A method according to claim 10, wherein the predetermined input signals for the intake air quantity estimation unit includes engine revolutions and intake pressure.

17. A method according to claim 10, wherein the predetermined signals for the intake fuel quantity estimation unit are selected from the group consisting of signals of engine revolutions, throttle angle, intake pressure, engine temperature, and intake pipe wall temperature, and a signal of the estimated intake air quantity outputted from the intake air quantity estimation unit, in addition to the fuel injection signal outputted from the feedback control unit.

18. A method according to claim 10, wherein the predetermined signals for the target air-fuel ratio setting unit are selected from the group consisting of signals of engine temperature and engine revolutions, and a signal of the estimated intake air quantity outputted from the intake air quantity estimation unit.

* * * * *